United States Patent [19]

Nanamura et al.

[11] Patent Number: 4,888,616

[45] Date of Patent: Dec. 19, 1989

[54] IMAGE PROCESSING APPARATUS

[75] Inventors: Masanori Nanamura, Kawasaki; Masao Hosaka; Mutsuhiro Inouye, both of Sagamihara, all of Japan

[73] Assignee: Canon Kabushiki Kaisha, Tokyo, Japan

[21] Appl. No.: 235,790

[22] Filed: Aug. 23, 1988

Related U.S. Application Data

[63] Continuation of Ser. No. 869,688, Jun. 2, 1986, abandoned.

[30] Foreign Application Priority Data

| | | | |
|---|---|---|---|
| Jun. 7, 1985 | [JP] | Japan | 60-124699 |
| Jul. 2, 1985 | [JP] | Japan | 60-145994 |
| Jul. 2, 1985 | [JP] | Japan | 60-145995 |
| Jul. 2, 1985 | [JP] | Japan | 60-145996 |
| Jul. 2, 1985 | [JP] | Japan | 60-145997 |
| Jul. 2, 1985 | [JP] | Japan | 60-145998 |

[51] Int. Cl.[4] ..... G03G 21/00

[52] U.S. Cl. ..... 355/202; 346/153.1; 355/71; 355/214; 358/300

[58] Field of Search ..... 355/3 R, 14 C, 14 E, 355/71, 202, 218; 346/153.1, 160; 358/300

[56] References Cited

U.S. PATENT DOCUMENTS

| | | | |
|---|---|---|---|
| 4,046,471 | 9/1977 | Branham et al. | 355/3 R X |
| 4,153,364 | 5/1979 | Suzuki et al. | 355/14 |
| 4,166,691 | 9/1979 | Ebi et al. | 355/3 DD X |
| 4,215,930 | 8/1980 | Miyakawa et al. | 355/14 D |
| 4,239,374 | 12/1980 | Tatsumi et al. | 355/14 E |
| 4,327,990 | 5/1982 | Tago | 355/14 E X |
| 4,450,458 | 5/1984 | Araghi et al. | 346/155 |
| 4,544,263 | 10/1985 | Sasaki et al. | 355/14 E |
| 4,551,008 | 11/1985 | Banton | 355/14 E |
| 4,586,814 | 5/1986 | Tokuhara et al. | 355/55 |
| 4,697,910 | 10/1987 | Kasuya | 355/3 R |

*Primary Examiner*—Fred L. Braun

*Attorney, Agent, or Firm*—Fitzpatrick, Cella, Harper & Scinto

[57] ABSTRACT

An image processor includes a light source, a scanner for scanning an original document using the light source, an imager for forming an image on the basis of light reflected from the original document and a light from the light source, a controller having a plurality of electro-mechanical transducer elements arranged in a light path from the light source to the imager, a generator for generating image data, and a driver for driving the controller in accordance with the image data. The driver drives the light controller in accordance with the image data, thereby causing the imager to form an image corresponding to the image data. The light source is adapted for forming an image corresponding to the original document and an image corresponding to the image data.

15 Claims, 26 Drawing Sheets

DIRECT COPY
(ANALOG COPY)

ARER DESIGNATED COPY
(REDUCED OR ENLARGED
ANALOG COPY)

ADDITIONAL COPY
(ANALOG AND DIGITAL COPIES)
ABCDE

COMPOSITE COPY
(ANALOG AND DIGITAL COPIES
ABCD
XYZ

DOCUMENT
SHEET
V-H CONVERSION FONT CONVERSION
(DIGITAL COPY)

DOUBLE-SIDED COPY
(ANALOG COPY ON ONE
SIDE AND DIGITAL COPY
ON THE OTHER SIDE)

DIRECT COPY (ANALOG COPY)

PARTIAL CHARACTER INSERTION (ANALOG AND DIGITAL COPIES)

APPENDED COPY (ANALOG AND DIGITAL COPIES)
ABCDE

COMPOSITE COPY (ANALOG AND DIGITAL COPIES)
ABCD
XYZ

DOUBLE SIDED COPY (ANALOG COPY ON ONE SIDE AND DIGITAL COPY ON THE OTHER SIDE)

ORIGINAL SHEET
CONVERTED OR CLEAN COPY (DIGITAL COPY)

MULTIPLE COPY (ANALOG AND DIGITAL COPIES)
COPY UNABLE

IMAGE PROCESSING APPARATUS

This application is a continuation of application Ser. No. 869,688 filed June 2, 1986, now abandoned.

BACKGROUND OF THE INVENTION

1. Field of the Invention

The present invention relates to an image processing apparatus which uses a semiconductor optical element.

2. Related Background Art

A copying machine for copying a document has been known as such an image processing apparatus.

Recently, an OA equipment such as a word processor or a computer is connected to the copying machine to form one system, and a digital copying machine having an image reader and a laser beam printer has been developed to allow systematic use of the copying machine.

However, such a digital copying machine is of lower image quality and more expensive in cost than an analog copying machine.

On the other hand, the analog copying machine cannot be used in the system because it cannot transmit an image.

Thus, an apparatus having both functions of analog recording and digital recording has been demanded and it is necessary to develop an optical system which is applicable to such an apparatus.

As an optical system which is compatible to both analog and digital recording systems, a laser optical system such as a laser beam printer (LBP) may be used. In this system, however, an read sensor is required and hence a complex and large size structure is needed and a cost increases. When its liquid display printer or an LED printer having a read sensor is used, the same problem as that in the laser optical system exists.

SUMMARY OF THE INVENTION

It is an object of the present invention to provide an improved image processing apparatus.

It is another object of the present invention to eliminate the disadvantages encountered in the prior art apparatus.

It is a further object of the present invention to provide a low cost image processing apparatus of a simple construction.

It is yet another object of the present invention to provide an analog/digital recording optical system which is of low cost and simple construction.

It is still another object of the present invention to provide an image processing apparatus capable of processing an analog image and a digital image by one optical system.

It is also another object of the present invention to provide an image processing apparatus for processing an analog and a digital image by a semiconductor optical element.

It is still a further object of the present invention to provide an image processing apparatus for processing an analog image by a semiconductor optical element.

Other objects of the present invention will be apparent from the description of preferred embodiments of the present invention.

DETAILED DESCRIPTION OF THE PREFERRED EMBODIMENTS

A semiconductor optical system used in an embodiment of the present invention is first explained. The present embodiment uses a DMD (deformable mirror device) which is an electro-mechanical transducer having a small mirror which is swingable by an electrical signal.

The DMD element is described in IEEE transaction on Electron Device, Vol. 1 ED-30, No. 5544 (1983), and the optical system is disclosed in Japanese Patent Application Laid-Open No. 17525/1984.

A principle of the DMD element is now explained.

Figure 3A:
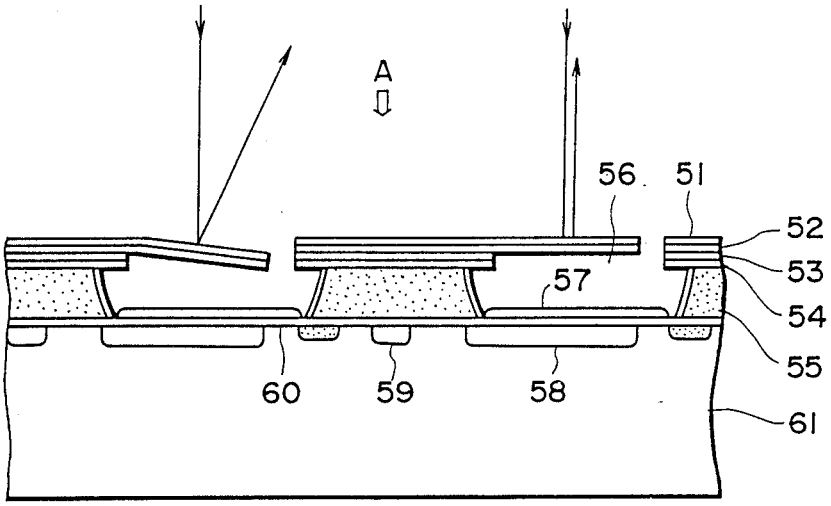
FIGS. 3A–3C and 4 show a deformable mirror device (DMD)

FIG. 3A shows a sectional view of the DMD. Numeral 51 denotes a small reflection plane of a mirror structure which is made of Al (aluminum) or Ag (silver) and functions to reflect an incident light. Numeral 52 denotes a substrate, for supporting the mirror structure 51, which is made of Au (gold). Numerals 53 and 54 denote support members. The member 53 is a mirror contact which supports a hinge which electro-mechanically functions and the member 54 is a polyoxide silicon insulator. Numeral 55 denotes a silicon gate which functions as a gate of a MOS type FET transistor. Numeral 56 denotes an air gap having a cavity of 0.6 μm to several μm. Numeral 57 denotes a floating field plate. A voltage is applied to the floating field plate 57 in accordance with a transistor ON/OFF information from an N+ floating source 58. Numeral 59 denotes an N+ drain. It also serves as a structure of the MOS type FET transistor Numeral 60 denotes a gate oxide and numeral 61 denotes a P type silicon substrate.

Figure 3B:
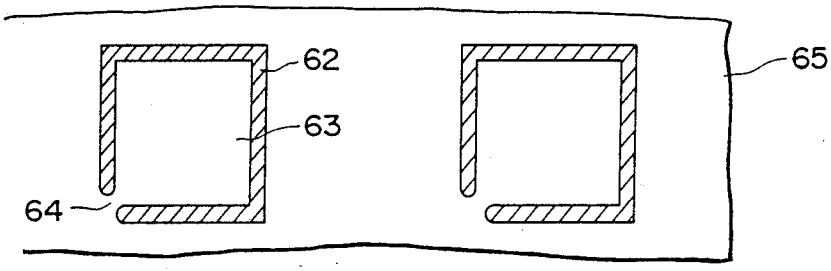

FIG. 3B is a perspective view as viewed in a direction A in FIG. 3A. Numeral 62 denotes an air gap, numeral 63 denotes an electro-mechanically swingable mirror and numeral 64 denotes a hinge. The DMD may be manufactured in a similar process to that for an IC or LSI.

Figure 3C:
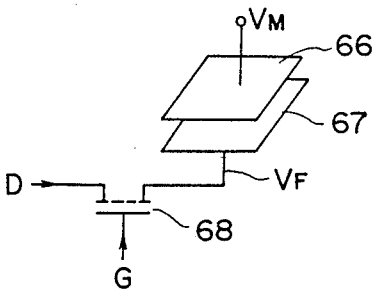

FIG. 3C shows an electrical equipment circuit of the DMD. Numeral 66 denotes an electrode corresponding to the mirror 51 and the support member 52 and to which a voltage $V_M$ is applied. Numeral 67 denotes an electrode which corresponds to the floating source 58 and to which a voltage VF is applied. Numeral 68 denotes a transistor structure. The voltage $V_f$ is turned ON and OFF in accordance with turn-ON and turn-OFF of a drain (D) signal at 59 and a gate (G) signal at 55. In FIG. 3A, the voltage $V_M$ is applied to the mirror 51 and the support member 52 and a voltage between the mirror 51 and the support member 52, and the floating source 58 is increased or decreased in accordance with the ON/OFF signals. A force F is developed between the air gap 56 and the floating field plate 57 in accordance with the voltage.

$$F \sim KV^{\alpha}$$

where K is a constant, V is the voltage, $\alpha$ is a constant and F is a bending force As a result, the mirror 51 and the support member 52 are swung at the hinge 64.

In a left portion of FIG. 3A, the voltage between the mirror 51 and the support member 52, and the floating source 58 is large and the mirror is bent at the hinge. As a result, an incident light is reflected with a double angle of a swing angle of the mirror On the other hand, when the voltage is small, the mirror (mirror 51 and support member 52) is not bent because a pulling force by the floating field plate is small. As a result, the incident light is reflected with the mirror not being swung. Thus, the DMD element transduces the electrical ON/OFF to the mirror swing ON/-OFF and further transduces it to a light swing angle.

Figure 4:
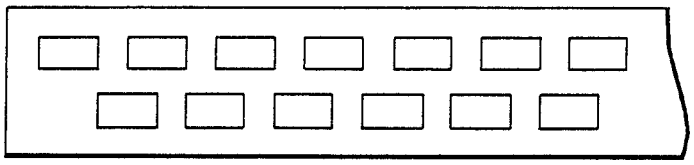

As shown in FIG. 4, a number of such DMD elements are arranged in array. They electro-mechanically respond to a drive signal in accordance with the principle of operation illustrated in FIGS. 3A–3C, and one of the elements in the array of FIG. 4 corresponding to the signal is swung.

Figure 5:
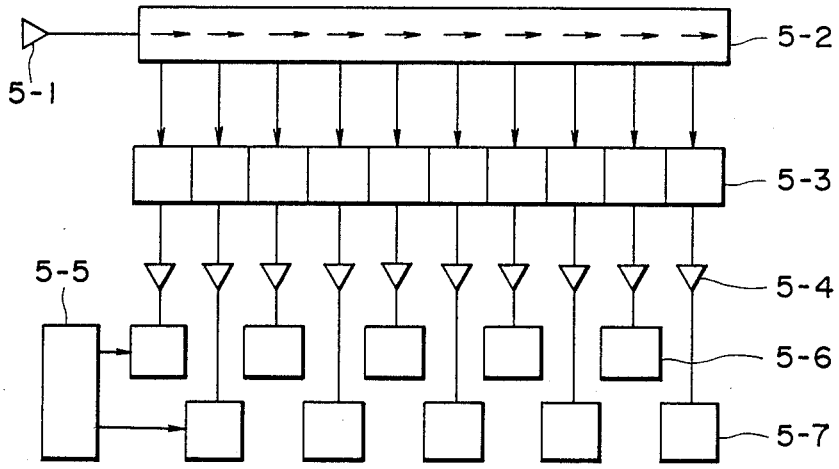
FIG. 5 shows a DMD driver 70.

FIG. 5 shows the driver 70 for the DMD elements. Numeral 5-1 denotes an input signal amplifier which produces an ON/OFF signal for a binary signal and a voltage corresponding to an amplitude for an analog signal. Since the signal is usually a serial signal, it is converted by a serial-parallel converter 5-2 to parallel signals equal in numbers to the number of vibration mirrors of the DMD elements and they are stored in a register 5-3. The signals are read out one line at a time by a synchronization signal so that predetermined voltage signals are applied to the drains of the DMD elements of two lines 5-6 and 5-7. On the other hand, a decoder 5-5 supplies gate signals to the DMD elements in response to the synchronization signal. The voltages at the floating sources of the DMD elements are transferred to the floating field plates in accordance with the amplitudes of the drain signals or the presence or absence of the drain signals, and the presence or absence of the gate signals for the respective lines to determine ON/OFF states of the small mirrors.

The present embodiment uses the above DMD elements to realize the image processing apparatus having the analog copying function and the digital copying function.

Figure 1:
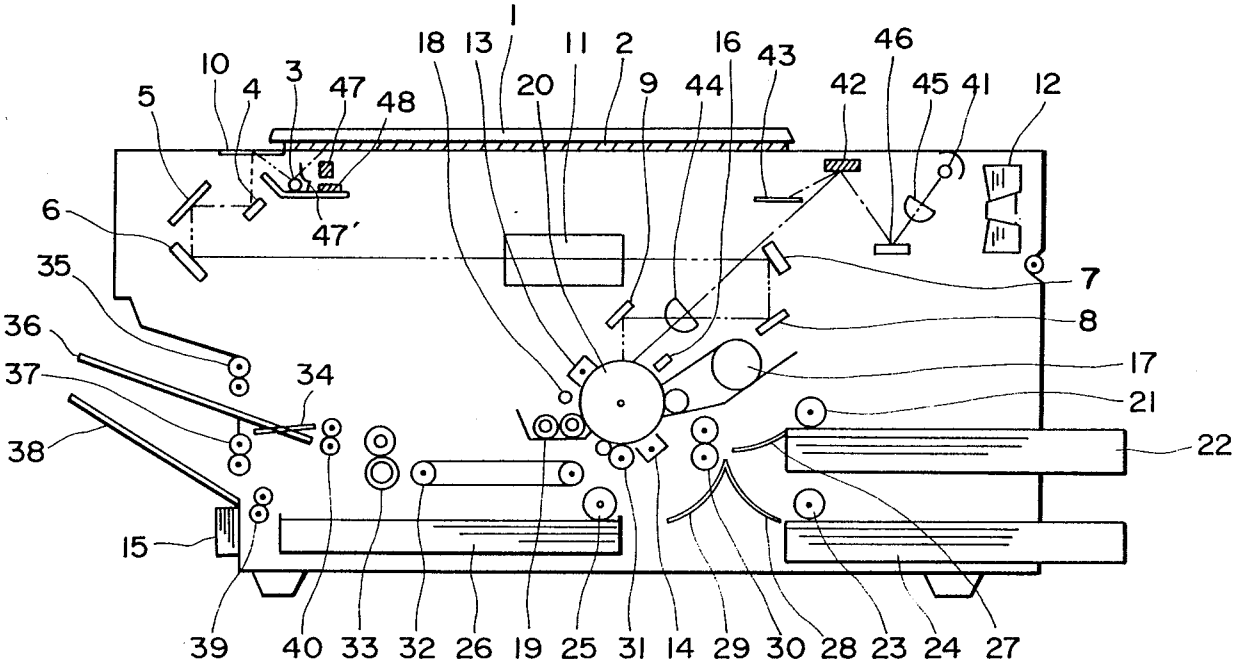
FIG. 1 shows an analog/digital copying machine.

FIG. 1 shows a sectional view of the analog/digital copying machine in accordance with the present embodiment.

The operation of the machine in the analog copy mode is first explained.

The copying machine comprises four blocks, a paper feed unit, an exposure unit, an imaging unit and a control unit.

An operator opens a document table cover 1 to set a document sheet on a document table 2. The operator then sets a copy mode through a console unit (not shown). For example, when a reduction or enlarge mode is to be set, the operator sets the magnification by a magnification key, and sets the number of copies, a density of copies, manual selection, a copy mode and one side or double side copy by corresponding keys.

The double side copy mode is explained below. When the operator selects the double side copy mode and depresses a copy start key, a halogen lamp 3 is turned on, a photoconductor drum 20 is rotated and a charging corona 13 is energized. The halogen lamp 3 and a first mirror 4 are in one structure which scans the document sheet on the document table 2.

The scanned image is focused onto the photoconductor drum 20 through the first mirror 4, a second mirror 5, a third mirror 6, a zoom lens 11, a fourth mirror 7, a fifth mirror 8 and a sixth mirror 9.

The image (latent image) focused on the drum 20 is exposed by a light from a DMD/erasing light source 41 through a focusing lens 45, a DMD light source reflection mirror 46, a DMD line element 42 and a DMD element focusing lens 44 so that a surface potential in an area on which the latent image on the drum 20 is not focused is eliminated in accordance with a size of the text sheet and a size of a copy sheet. The latent image is developed by a developing unit 17 so that toners are deposited to the latent image to produce a visible image. The copy sheet fed from a selected paper cassette 22 or 24 stands by at a register roller 30, which is rotated at a predetermined timing to register the copy paper with the image on the drum 20, and the image on the drum 20 is transferred to the copy paper when a transfer corona 14 is energized.

The copy paper is then separated from the drum 20 by a separation roller 31 and fed to a fixing unit 33 by a paper feed belt 32. In the fixing unit 33, heat and pressure are applied and the toners are fused.

In the dual side copy mode, a paper guide plate 34 is in a position to guide the copy paper to an eject roller 37 so that the copy paper is fed to a double side eject table 38 by the paper guide plate 34 and the eject roller 37.

The copy paper fed to the double side eject table 38 slips down by gravity and is pinched by a roller 39 and stacked in an intermediate cassette 26. In this manner, copies are made on first sides of the papers equal in number to the number of copies initially set by the operator and they are stacked in the intermediate cassette 26.

On the other hand, the image on the drum 20 after the transfer is cleaned by a cleaning unit 19 so that toners remaining on the drum 20 are removed. The drum 20 is exposed to a discharging lamp 18 to remove a residual potential on the drum 20. The drum 20 is then charged to a predetermined surface potential by a discharging corona 13 and a new image is focused.

After the copying on the first surfaces, the operator turns over the document sheet to start the copying on the second surfaces. As the operator sets the document sheet and depress the copy start key (not shown), the second surface copying is started. The image is focused on the drum 20 and the toners are deposited by the developing unit 17 to provide a visible image, as was done in the first surface copy mode.

The copy paper having the copy image formed on the first surface is fed from the intermediate cassette 26 by the rotation of the paper feed roller 25 at a predetermined timing, and the copy paper is reversed by the guide plate 29 and pinched by the register roller. The copy paper stands by in the pinched status by the register roller 30 until a controller (not shown) supplies a start signal at a predetermined timing to a drive unit (not shown) of the register roller 30 to register the copy paper with the leading edge of the image.

At the predetermined timing for registering, the register roller 30 is rotated and the image formed on the photoconductor drum 20 is transferred to the second surface of the copy paper, the toners are fixed by the fixing unit 33 and the copy paper is pinched by a paper guide plate guide roller 40. Since the paper guide plate 34 is in the eject table position, the copy paper is ejected to the eject table 36. In this manner, the double side copies equal in number to the number of copies initially set by the operator are produced.

In the single side copy mode, the paper guide plate 34 is in the eject table position. In the second surface-only copy mode, the copy paper fed from the cassette 22 or 24 is fed to the intermediate cassette 26 by the paper feed unit with no image formed on the first surface. During this operation, the imaging unit is not operated and only the paper feed unit is operated to feed the copy paper from the paper cassette 22 or 24 to the intermediate cassette 26.

An auto-exposure function is provided to enhance a quality of copy. It controls the surface potential of the photoconductor drum to a constant level so that a density is maintained at an optimum level without regard to a density of the text image. Prior to the start of copying, the surface potential is monitored. A light emitted from the exposure lamp 3 and reflected by a standard reflection plate 10 is directed to the photosensitive drum 20, and the surface potential is detected by a surface potential sensor 16 and the corona charger 13 is controlled to maintain the surface potential at an appropriate level. In the copy mode, when the operator selects an automatic copy density adjustment mode, the optical system prescans the document sheet to detect the density of the text image and a corona voltage and a bias voltage are set in accordance with the detected density. When it is troublesome to prescan the text sheet for monitoring for each copy, the text image density may be detected by the surface potential sensor 16 in real time and the developing bias of the developing unit 17 may be controlled to attain an optimum density. In a continuous copy mode (where a plurality of copies of each document sheet are made), the corona voltage and the lamp intensity are optimum after the first copy has been made. The document sheet is prescanned, the light reflected from the document sheet is sampled, and the light intensity of the exposure lamp and the developing bias potential are controlled in accordance with the sampled light to maintain the reproduced image density at the optimum level.

A printer mode of operation is now explained.

Figure 6:
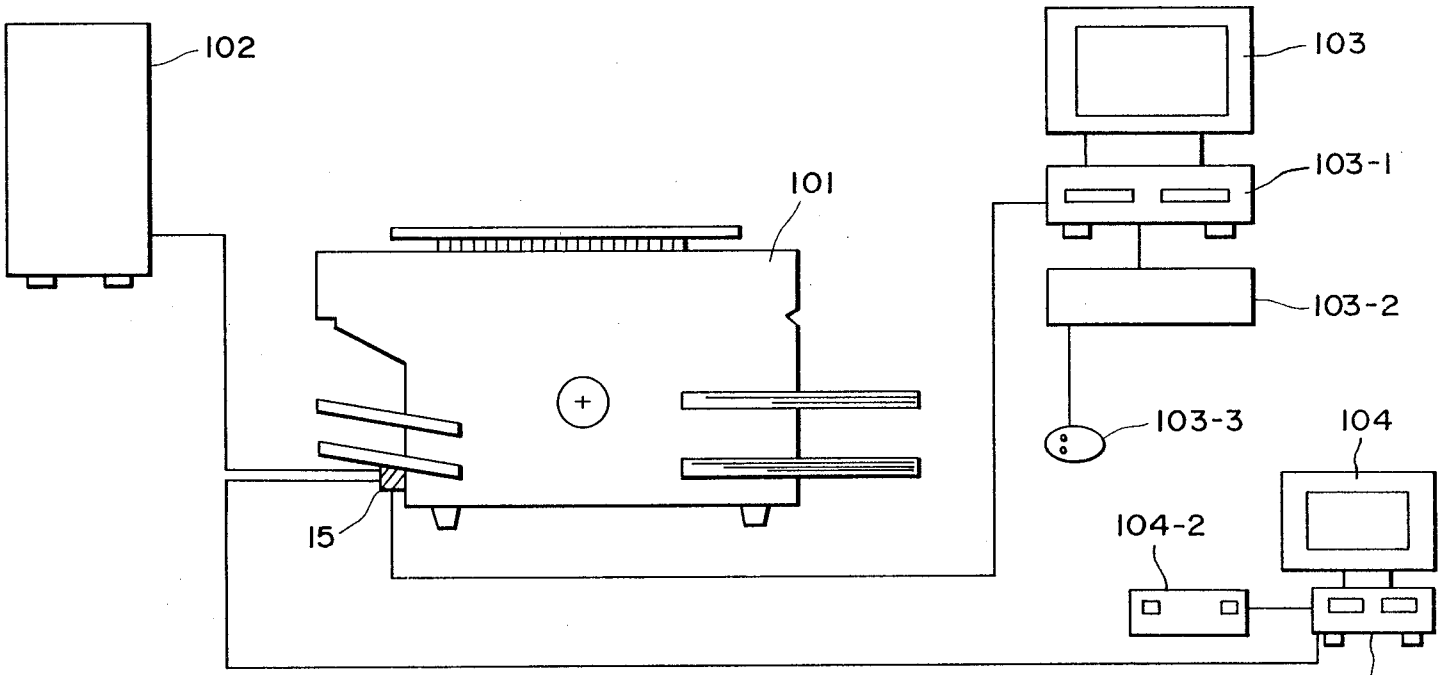
FIG. 6 shows a system configuration.

FIG. 6 shows a system configuration. In the printer mode of operation, data supplied from 0A equipments such as personal computer/word processor 103 and 104, and a data base 102 through an interface 15 such as RS232C are printed out by an analog/digital copying machine 101 of the present embodiment In the printer mode of operation, the optical system of the analog copying machine is fixed at the start position and the exposure lamp 3 is kept turned off.

The light from the DMD/erase light source 41 passes through the focusing lens 45 and is reflected by the DMD light reflection mirror 46, and it is irradiated to the DMD elements 42 arranged in line (shown in FIGS. 3–5. The DMD/erase light source 41 may be either a halogen lamp or a fluorescent lamp. In any case, a stabilized power supply is required to keep the light intensity at a constant level. As explained in connection with FIGS. 3–5, the DMD elements 42 are turned ON and OFF in accordance with the image signal. For a white image signal, the DMD element is turned OFF, and for a black image signal, the DMD element is turned ON so that the light is blocked by a douser 43 to prevent the light from being directed to the photoconductor drum 20.

The light reflected by the DMD element 42 passes through the DMD element focusing lens 44 and is focused onto the photoconductor drum 20. The image is then transferred to the copy paper.

In the printer mode of operation, the surface potential is detected by the surface potential sensor 16 as is done in the analog copy mode, and the developing unit 17 and the corona charger 13 are controlled to keep the surface potential at a predetermined level.

In the analog copy mode, the optical system of the DMD elements is activated to designate an area such as partial erasure area of the text image, and the digital data supplied from the external equipment such as personal computer or word processor through the interface are printed out by the analog/digital copying machine to effect multiple recording.

The edit functions such as area designation and multiple recording are now explained. The operation thereof is first explained. The analog/digital copying machine of the present invention also has a function of being an image reader. When the operator selects an image read mode by the console panel (not shown), the text sheet on the text table 2 is exposed to the exposure lamp 3 through a slit 47' and a light reflected therefrom is read by a CCD image sensor 48 as an image signal through a short focal distance lens array (fiber lens) 47. The reading of the text sheet by the CCD image sensor 48 may be carried out simultaneoulsy with the normal analog copy operation. The CCD image sensor 48 has a resolution power of 16 lines/mm. In the present embodiment, a unity magnification CCD is used.

The image signal read by the CCD image sensor 48 is supplied to the external equipment such as personal computer or word processor through the interface 15, which processes the image signal. The processed image is supplied through the interface 15 and the optical system of the DMD element 42 is energized to form the image. The analog copy is made by the optical system 3–9 and the image is deleted or inserted by the DMD optical system 42. In the analog copy mode, the DMD optical system 42 functions to erase the image (or to direct the light on the undesired area on the photoconductor drum to decrease the potential).

If a command is issued to the machine to print out the data of the personal computer during the analog copy mode, the analog copying is imparted with a priority and the personal computer output is queued. A Dip switch (not shown) may be arranged under the control unit or at a corner of the machine so that the operator can selectively impart the priority to the functions, or the priority may be determined by a program in the control unit of the machine.

The image read by the CCD image sensor 48 of the analog/digital copying machine of the present embodiment is supplied to the personal computer 103 through the interface 15 and the image is drawn on a screen of the personal computer 103. The document image addressed by x and y coordinates is drawn on the screen of the personal computer 103, and the image may be stored in a floppy disk (FD) 103-1 as required. An area of the image which should be erased or added is designated by a keyboard 103-2 and a mouse 103-3 and the image is partially deleted or added. This operation can be carried out in parallel with the analog copy operation.

Before the image edition is explained, the control unit of the present embodiment is explained.

Figure 2A:
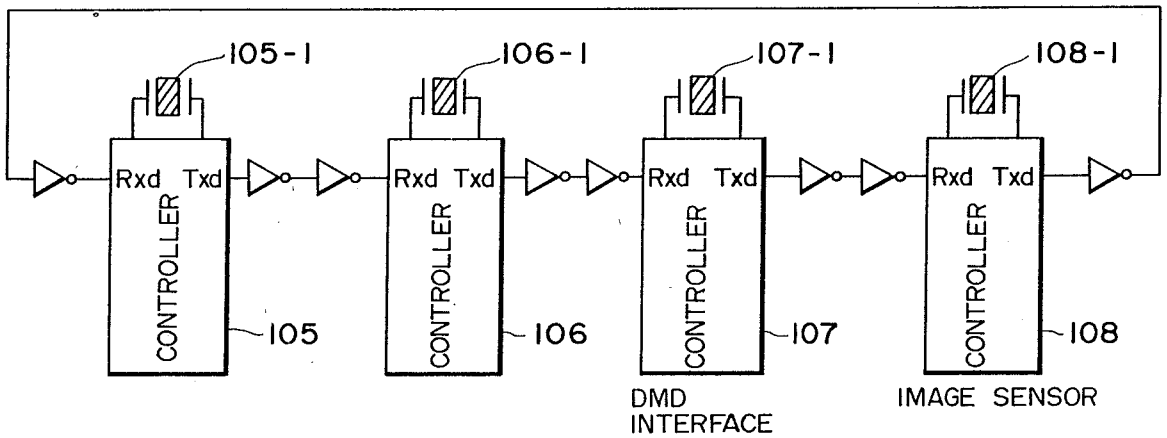
FIGS. 2A–E show a control unit of an embodiment of the present invention.

The control unit of the analog/digital copying machine of the present invention comprises four controllers. FIG. 2A shows the four controllers of the control unit of the present embodiment.

A controller 105 controls the analog copy and the mechanics and electronics for controlling the electrophotography. A controller 106 controls a console display (not shown) a main drive motor, a servo motor of the text sheet scan unit and a pulse motor for driving the zoom lens. A controller 107 mainly controls the DMD elements and the connection to the external equipment through the interface. The controller 107 has a line memory having a memory capacity approximately equal to 19.2 Kbytes (two lines). A controller 108 controls the CCD image sensor 48 for reading the image.

Figure 2B:
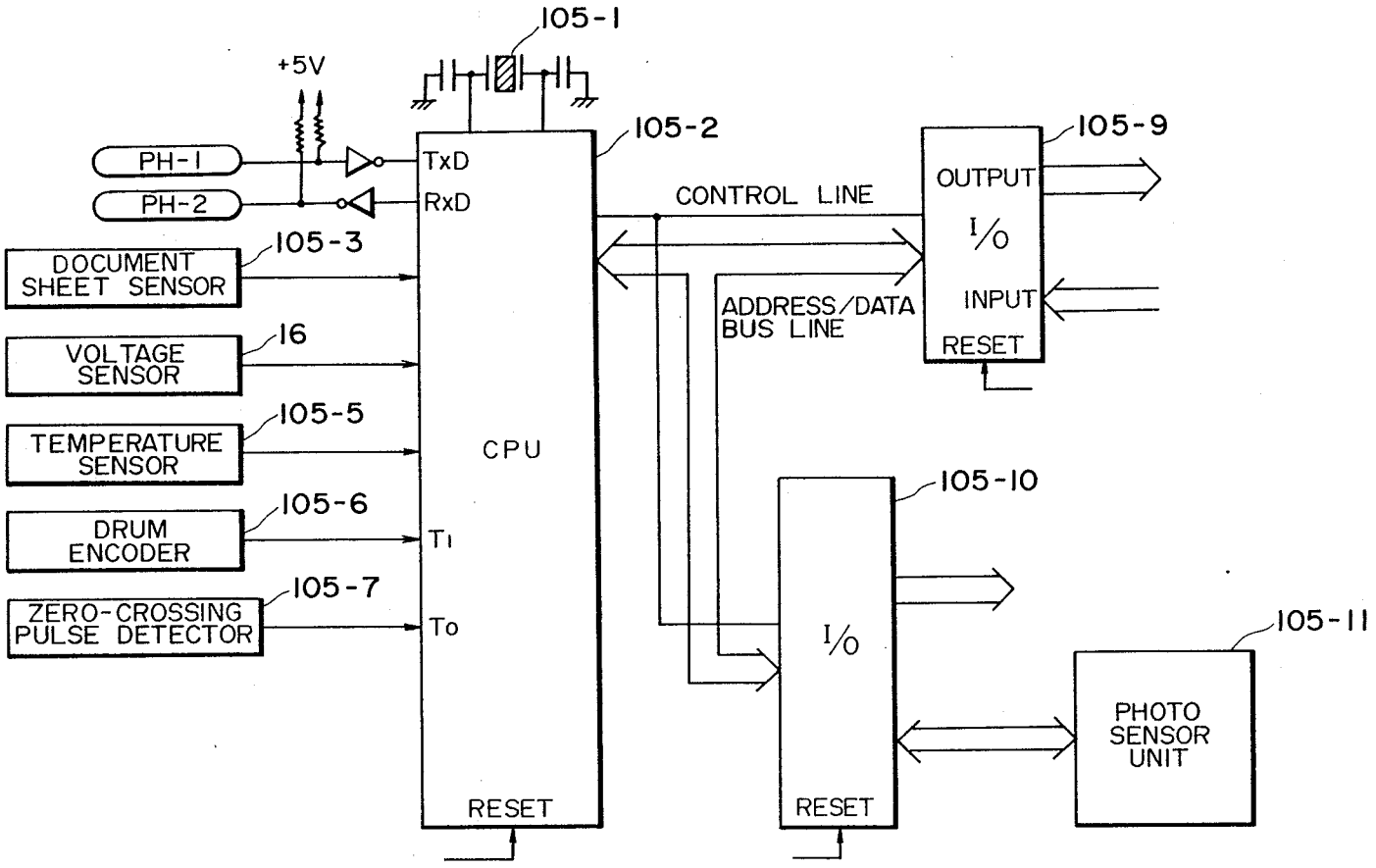

FIG. 2B shows a configuration the controller 105. Elements of the controller 105 are explained with reference to FIG. 2B. Numeral 105-1 denotes an oscillator for supplying a clock to a CPU 105-2, which is a control circuit of the controller 105 and comprises a microcomputer and peripheral equipments such as RAM and ROM. The CPU 105-2 is backed up by its battery so that it can retain information when a power supply is cut down. Numeral 105-3 denotes a document sensor for detecting the document sheet. Numeral 105-5 denotes a temperature sensor for controlling a temperature. The CPU 105-2 has an A/D converter for converting signals from the text sensor 105-3, a potential sensor_16 and the temperature sensor 105-5. Numeral 105-6 denotes a drum encoder which counts up encoder pulses generated as the drum drive motor of the copying machine is rotated to supply a timing control pulse $T_1$ to the CPU 105-2. Numeral 105-7 denotes a zero-crossing pulse detector which detects a zero-crossing pulse $T_0$ of an AC power supply. The zero-crossing pulse $T_0$ is used as a count pulse of a timer and for zero-crossing trigger of the AC power supply in the temperature and exposure lamp control. Numerals 105-9 and 105-10 denote I/O expansion chips. Numeral 105-11 denotes photo-sensors which comprise various sensors such as document sheet sensor and toner sensor. The controller 105 detects the document density pattern in accordance with the detection signals from the document sheet sensor 105-3 and the potential sensor 16. The CPU 105-2 of the controller 105 controls solenoids and clutches of the copying machine and the photo-sensor 105-11 through the I/O expansion chips 105-9 and 105-10.

Figure 2C:
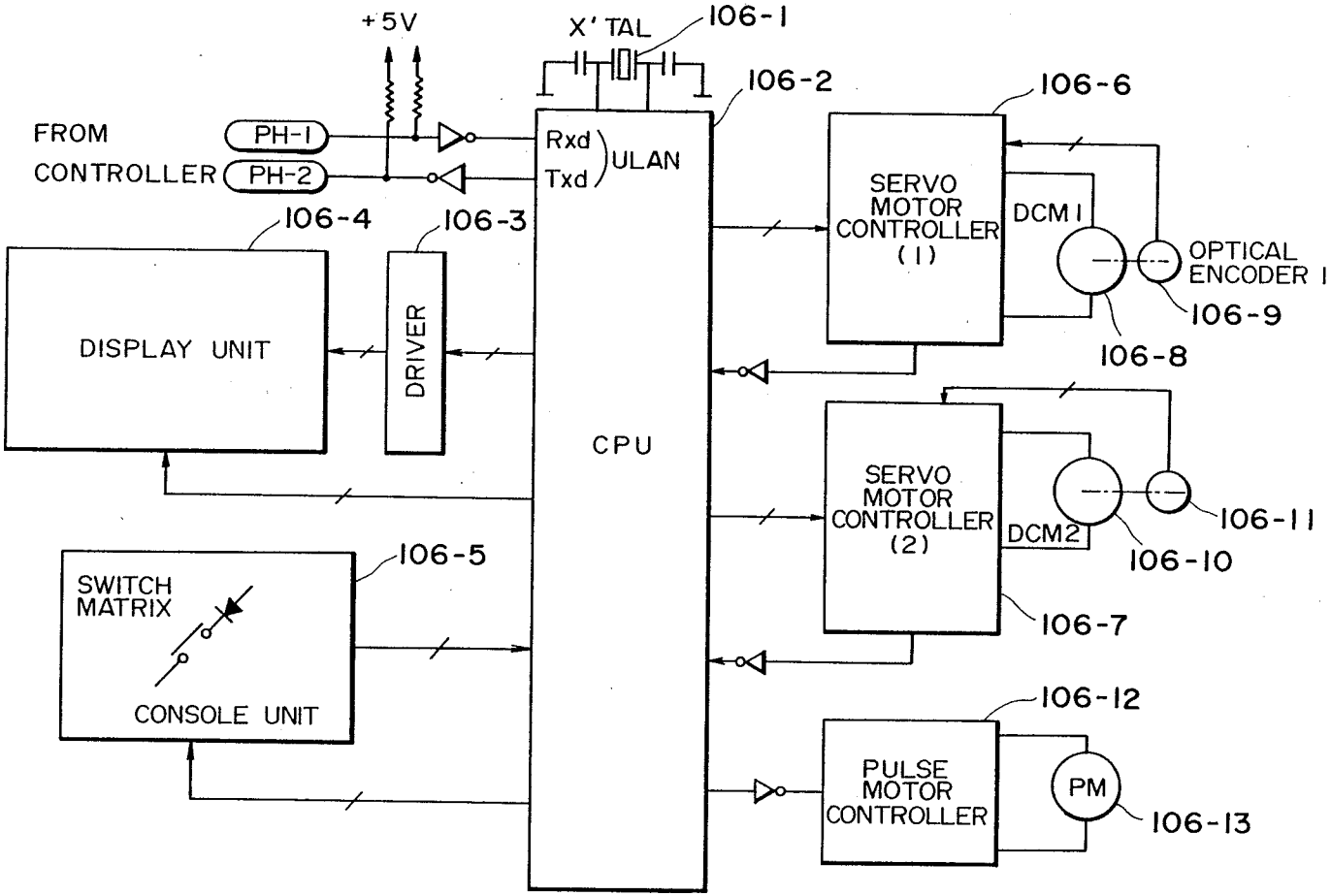

FIG. 2C shows a configuration of the controller 106. Numeral 106-1 denotes an oscillator for supplying a clock to a CPU 106-2 which is a control circuit of the controller 106 and comprises a microcomputer and peripheral equipments such as RAM and ROM. Numeral 106-3 denotes a driver for driving a display 106-4. Numeral 106-5 denotes a console unit for controlling the copying machine. Modes and operations of the copying machine are selected by switches of the console unit. Numeral 106-6 denotes a servo motor controller for driving a main motor 106-8. Numeral 106-9 denotes an optical encoder 1 for detecting motion of the main motor 106-8. Numeral 106-7 denotes a servo motor controller for controlling a servo motor 106-10 for scanning an optical system. Numeral 106-11 denotes an optical encoder 2 for detecting motion of the servo motor 106-10. Numeral 106-12 denotes a pulse motor controller for controlling a pulse motor 106-13 for driving a zoom lens. The controllers 105 and 106 control the normal copy processes such as paper feed, charging, exposure, development, transfer, conveyance, fixing, paper ejection and cleaning of the photoconductor drum.

The controller 105 detects error conditions including heavy errors such as abnormally high fixing temperature, abnormal turn-on of the exposure lamp and paper jam, and light errors such as paper exhaust and toner exhaust, by the output from the photo-sensor 105-11 and the software processing to perform a pre-copy error check.

The mechanics electronics control of the copying machine is characterized by a large number of inputs-/outputs and a large amount of real time processing. By utilizing a C-MOS gate array which has been increased recently, the number roof I/O may be increased, the peripheral circuit system can be simplified, the effective area of the circuit board is reduced and reliability is improved.

Figure 2D:
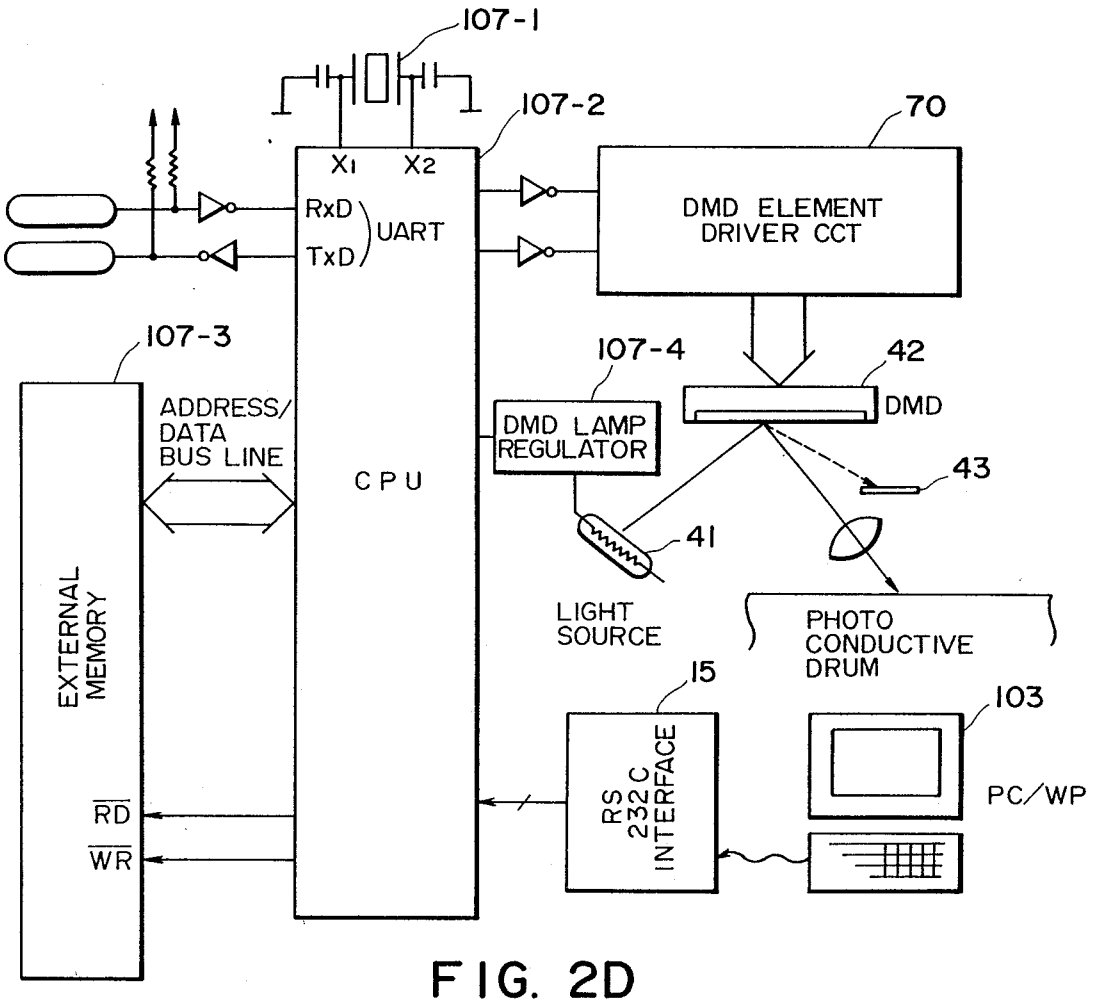

FIG. 2D shows a configuration of the controller 107. Numeral 107-1 denotes an oscillator for supplying a clock to a CPU 107-2 and comprises a microcomputer and peripheral equipments such as RAM and ROM. The CPU 107-2 also has a line buffer memory of several lines of capacity. Numeral 107-3 denotes an external memory for storing image data and information data. Numeral 107-4 denotes a lamp regulator for controlling the DMD/erase light source 41. The controller 107 receives data from the external equipment through the interface 15, temporarily stores it in the external memory 107-3 or the line buffer memory and sequentially supplies the data to the DMD drive circuit 70 to turn on and off the DMD to record the data.

Figure 2E:
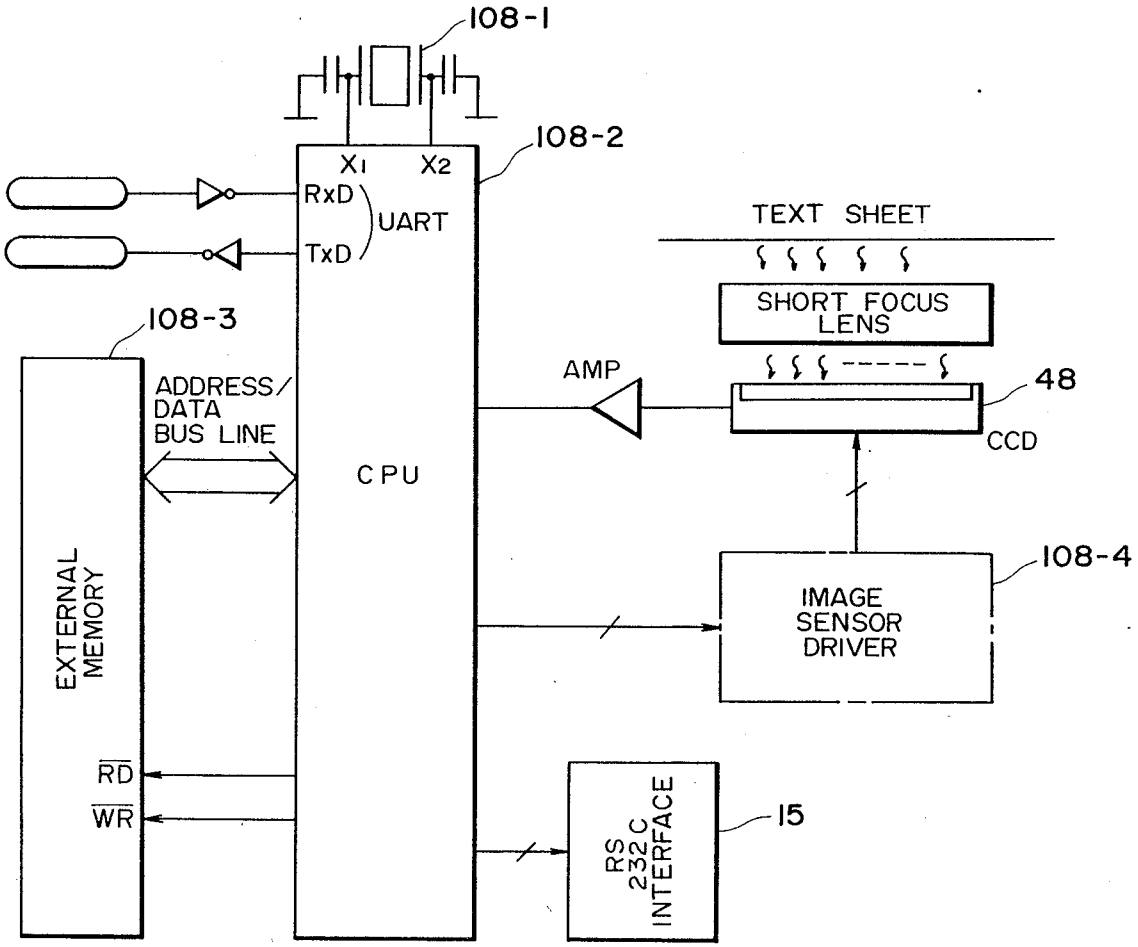

FIG. 2E shows a configuration of the controller 108. Numeral 108-1 denotes an oscillator for supplying a clock to a CPU 108-2 which is a control circuit of the controller 108 and comprises a microcomputer and peripheral equipments such as RAM and ROM. Numeral 108-3 denotes an image memory which stores an image signal read by the CCD image sensor 48. Numeral 108-4 denotes a driver for the CCD image sensor 48. The image read by the CCD image sensor 48 is stored by the CPU 108-2 into the image memory 108-3 having one page or several pages of capacity. In order to reduce cost, a buffer memory of several lines of capacity (approximately 20 Kbytes) may be provided instead of the image memory to transfer the data to the external equipment through the interface 15.

In this manner, the control unit controls the normal analog/digital copy operation and image editing.

As shown in the system configuration of FIG. 6, two personal computers/word processors (PC/WP) are connected to the analog/digital copying machine. Accordingly, data can be exchanged between the PC/WP 103 and 104, and the image information read by the reader of the copying machine can be displayed on both CRT screens or written into both memories.

Figures 7A, 7B, 7C, 7D, 7E, 7F:
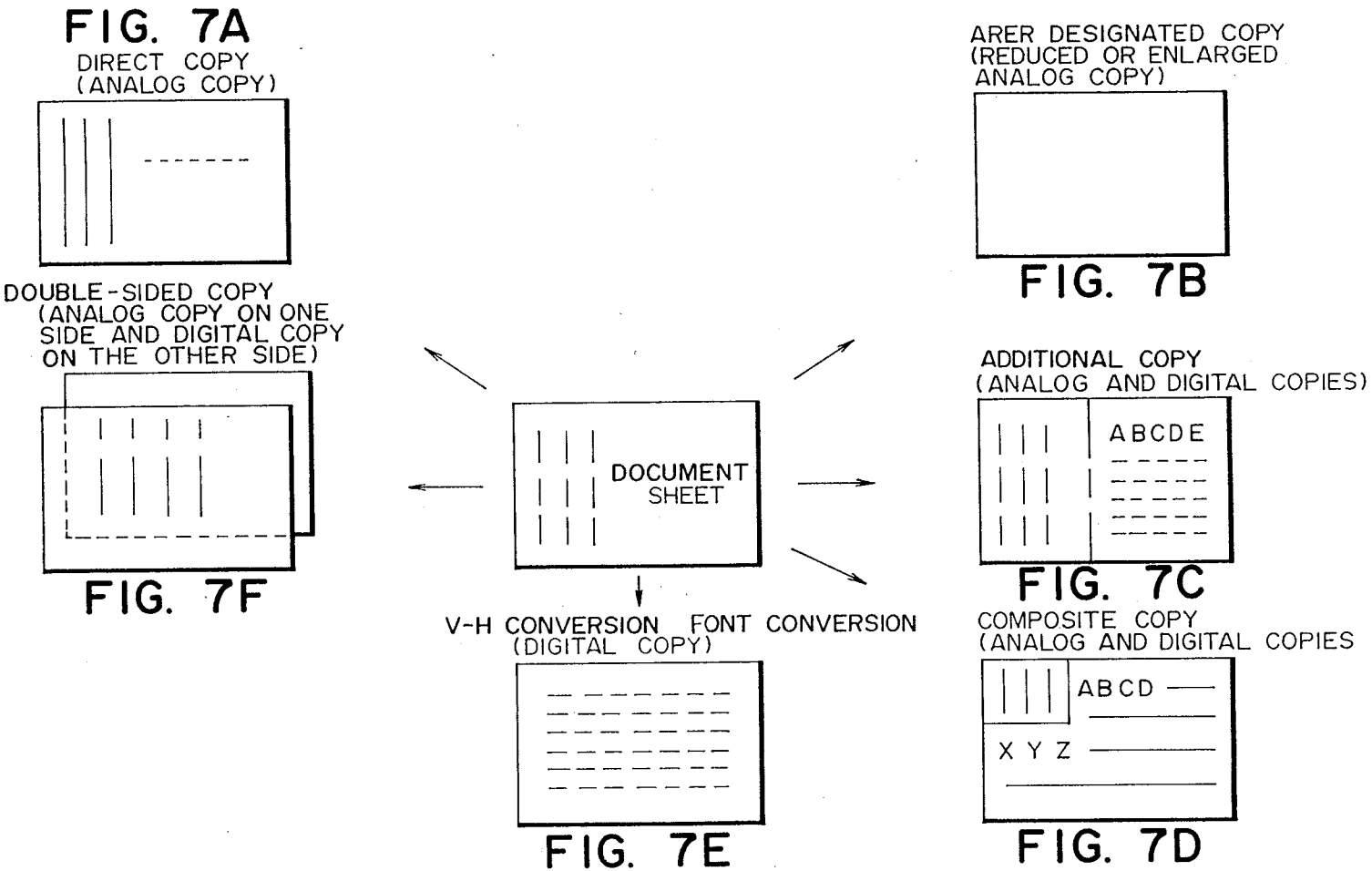
FIGS. 7A to 7F show examples of copy produced by the analog/digital copying machine of FIG. 1, FIGS. 8A, 8B, 8C consisting of 8C(A) and 8C(B), 8D consisting of 8D(A) and 8D(B), 8E, 8F consisting of 8F(A) and 8F(B), and 8G consisting of 8G(A) and 8G(B), show flow charts of operation of the embodiment.

FIGS. 7–7F shows examples of copies produced by the present system. In FIG. 7A, a normal copy of a document image is made by the analog copy function. In the analog copy mode, the document image can be enlarged or reduced by an enlarge/reduce mechanism of the machine. Such a command may be entered by a console switch of the console unit (not shown) of the machine, or by sending a command code from keyboards of the connected PC/WP 103 and 104 through the interface. The number of copies, a density of the copy, a magnification, a double side copy mode, a single side copy mode, blank mode (one or the other side of the copy paper is left blank) may be set or selected by the keyboards of the PC/WP 103 and 104.

In FIG. 7B, a designated area of the document image is analog-copied. The area is designated by the console unit (not shown) of the copying machine or the keyboards of the PC/WP 103 and 104. When the designated area is to be enlarged or reduced, the magnification is set. The analog/digital copying machine analog-scans the document and focuses the image onto the photoconductor drum. (If the image is to be enlarged or reduced, the zoom lens 11 enlarges or reduces the image in accordance with the preset magnification.) A light is exposed to an area other than the designated area on the latent image on the photoconductor drum 20 by the DMD 42 and the DMD optical system to erase the latent image in the other area. In this manner, the designated area of the document is analog-copied.

In FIG. 7C, one half is an analog copy and the other half is an image from the PC/WP, and those are combined in one image. The image may be enlarged or reduced at a desired magnification.

In FIG. 7D, an analog-copied and reduced image is formed in one corner, and the image in the remaining area is produced by the DMD printer head. In FIG. 7C, the analog/digital copying machine is set to an add mode by the console unit of the machine or the keyboard of the PC/WP 103 or 104. The additional data have been previously prepared by the PC/WP 103 or 104. When the copy operation is initiated, the document image is focused onto the photoconductor drum 20 by the analog optical system. When the end of the latent image of the document on the photoconductor drum 20 comes to the position of the DMD optical system, the additional data is supplied to DMD drive circuit 70 from the PC/WP 103 o 104 through the interface so that the additional data is written onto the photoconductor drum 20 by the DMD 42 and transferred to the copy paper.

In FIG. 7D, the analog/digital copying machine is set to a composite mode by the console unit of the machine or the keyboard of the PC/WP 103 or 104. In the composite mode, the magnification for the document image is determined and the size of the copy paper is determined. The data to be combined with the analog document image is prepared by the PC/WP 103 or 104. When the copy operation is initiated, the document image enlarged or reduced by the analog optical system is focused onto the photoconductor drum 20, and insertion data supplied from the PC/WP 103 or 104 through the interface 15 is written by the DMD 42.

In FIG. 7E, the image read by the CCD image sensor 48 is recognized by the PC/WP 103 or 104 and it is digital-copied by the DMD 42. Vertical writing may be converted to horizontal writing and vice versa. A user-written font may be used or characters may be recognized and corresponding characters may be generated by a character generator. Algorithms for recognition and vertical/horizontal conversion are stored in the floppy disks of the PC/WP 103 and 104.

In FIG. 7F, a double-sided copy is made. One side is digital-printed and the other side is analog-copied. For example, the one side is printed by the PC/WP 103 or 104, and the information is analog-copied on the other side.

Several examples of the copies have been shown and described. Many other ways of use may be considered. The images created by a plurality of PC/WP may be printed out into one image.

The auto-erase operation which uses the DMD optical system is now explained. The erase operation is carried out in accordance with the document, in accordance with the size of the copy paper or to erase the non-designated area in the area designated copy mode.

In the erase operation in accordance with the size of the copy paper, those DMD elements 42 which are within the width of the copy paper, for example size A4 paper, are turned on so that the outer frames of the size A4 are erased. The erase operation in the area designated copy will be explained later in connection with an area designation routine.

The erase operation in accordance with the document is explained below, with reference to FIG. 12. The surface of the document table cover 1 which faces the document table 2 has been specially processed so that the light from the exposure lamp 3 is not diffused-reflected by that surface of the document table cover 1 but always reflected to a constant direction t prevent the light from being directed to the CCD image sensor 48. On the other hand, when black information on the document is read by the CCD, a small quantity of light is directed to the CCD. As a result, a black level changes when the document is on the document table 2. Thus, the position of the document can be read by the CCD image sensor 48 based on the change of the black level.

As seen from FIG. 1, the read scan to the document table by the CCD image sensor 48 is always prior to the exposure scan of the document by the analog optical system.

The signal read by the CCD image sensor 48 is sequentially supplied to a comparator 12-1, and the signal read from the document is stored in a line memory 12-2 as "1" and the signal read from other than document is stored in the line memory 12-2 as "0". The signals are stored in the line memory 12-2 line by line. The line memory 12-2 has a capacity equal to or larger than the number of lines by which the CCD image sensor 48 advances to the analog optical system.

In synchronism with the exposure scan by the analog optical system, the signals are sequentially read out of the line memory 12-2 line by line, and they are amplified by an amplifier 12-3 and supplied to the DMD drive circuit 70. The DMD drive circuit 70 turns on those DMD elements 42 which are in the document area in accordance with the input signal. As a result, that portion of the light from the DMD/erase light source 41 which is within the document area in which the DMD elements are turned on does not reach the photoconductor drum 20 so that the area other than the document image area on the photoconductor drum 20 is erased. Further, by forcibly turning off the DMD elements at the opposite ends of the document area, black lines which would appear at the ends of the copy can be erased. In FIG. 12, the DMD elements in the areas a and b are off and the elements in the area c are on so that the area a' and b' on the photoconductor drum 20 are erased.

In this manner, the document table 2 is read-scanned by the CCD image sensor 48 to detect the document area, and the DMD 42 is driven in accordance with the detection output from the CCD image sensor 48. Accordingly, in whatever manner the document is mounted on the document table 2, the undesired area can be erased.

FIGS. 8A–8G show flow charts of control operations of the analog/digital copying machine of the present embodiment.

Figure 8A:
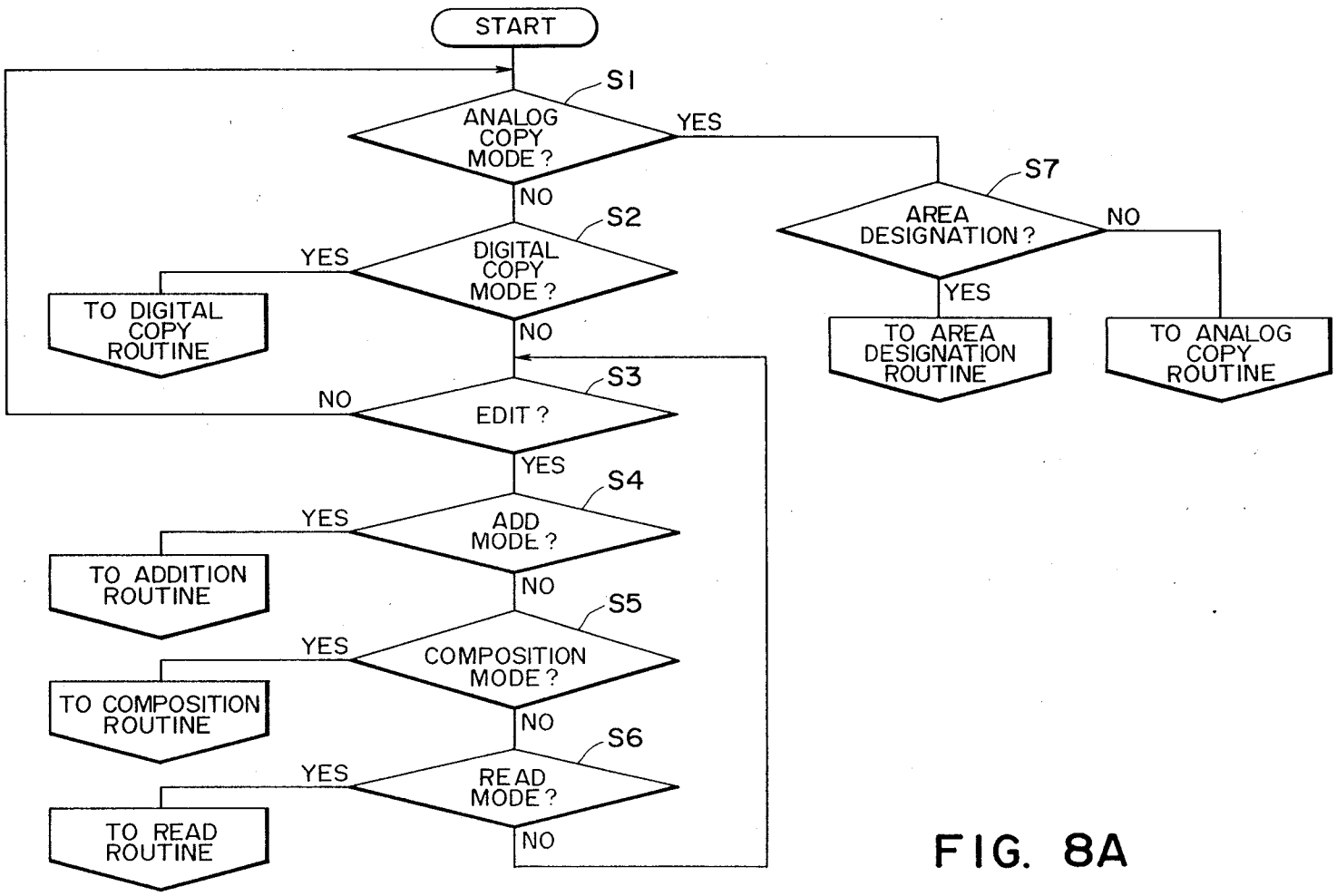

In a step S1 of FIG. 8A, whether the mode is normal analog copy mode or not is checked, and if it is the analog copy mode, the process proceeds to a step S7.

In a step S2, whether the mode is digital copy mode or not is checked, and if it is the digital copy mode, the process proceeds to a digital copy routine.

In a step S3, whether the mode is the editing mode of not is checked, and if it is the editing, the process proceeds to a step S4, and if it is not the editing, the process returns to the step S1.

In the step S4, whether the mode is the add mode or not is checked, and if it is the add mode, the process proceed to an add routine.

In a step S5, whether the mode is the composite mode or not is checked, and if it is the composite mode, the process proceeds to a composite routine In a step S6, whether the mode is the read mode or not is checked, and if it is the read mode, the process proceeds to a read routine, and if it is not the read mode, the process returns to the step S3.

In a step S7, whether the mode is the area designated copy mode or not is checked, and if it is, the process proceeds to an area designation routine, and if it is not, the process proceeds to an analog copy routine.

In the flow chart of FIG. 8A, the mode of the analog/digital copying machine is checked.

Figure 8B:
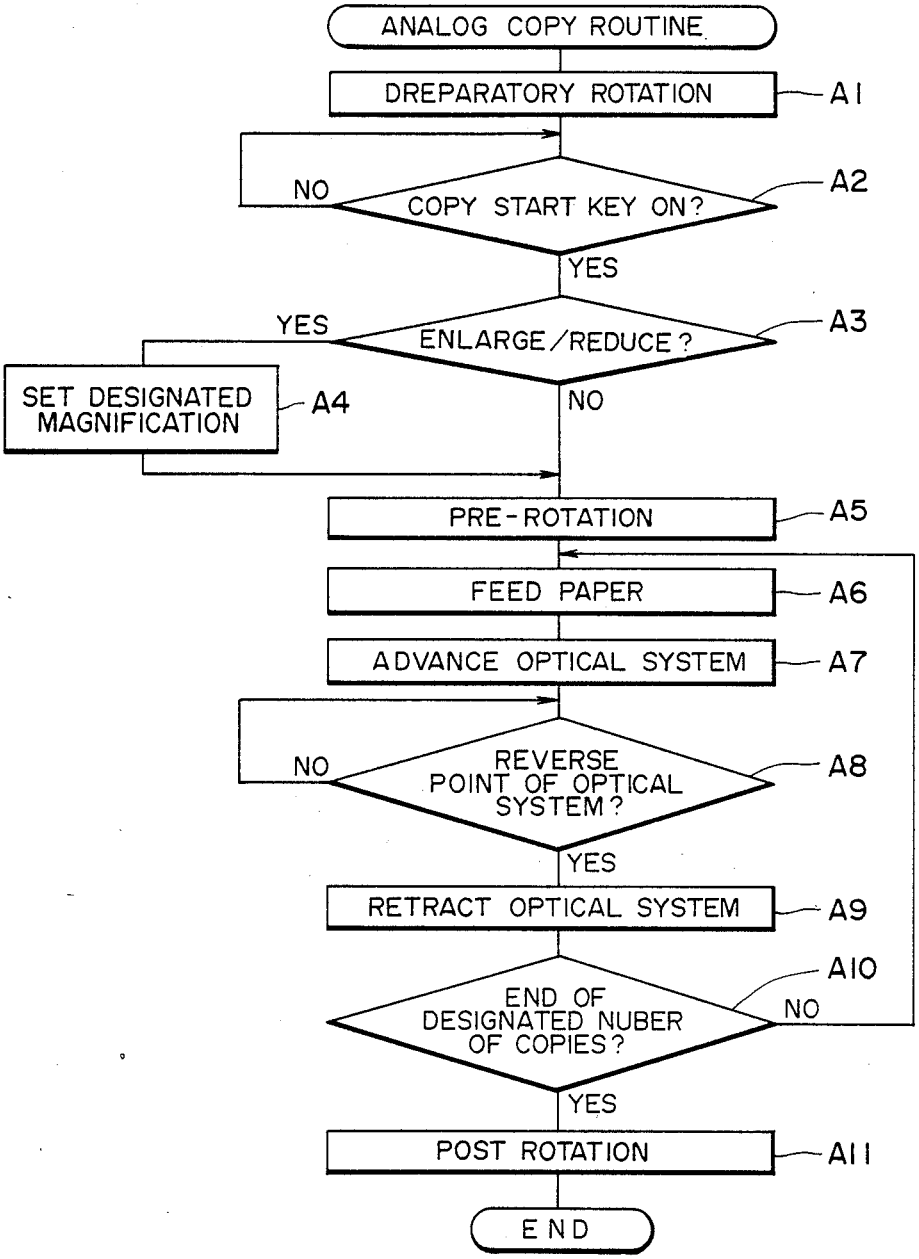

FIG. 8B shows the analog copy routine.

In a step A1 of FIG. 8B, the photoconductor drum 20 is rotated to render the surface of the photoconductor drum 20 to be ready for copying.

In a step A2, the copy start key is depressed, and in a step A3, whether an enlarge/reduce copy mode is designated or not is checked, and if it is, the lens is set to a designated magnification in a step A4 and the process proceeds to a step A5. If it is not the enlarge/reduce copy mode, the lens is set to the unity magnification and the process proceeds to a step A5.

In the step A5, the photoconductor drum 20 is pre-rotated to electrostatically clean the surface of the photoconductor drum 20.

In a step A6, a copy paper of a designated size is taken out of the paper cassette 22 or 24 and it is fed to the register roller 30.

In a step A7, the optical system (exposure lamp 3 and first mirror 4) is advanced to exposure-scan the document to focus the document image onto the photoconductor drum 20, and the image is registered to the copy paper at the register roller 30 and the document image on the photoconductor drum 20 is transferred to the copy paper.

In a step A8, the exposure scan of the document is terminated and whether the optical system is at a reversal position or not is checked, and if it is, the process proceeds to a step A9 where the optical system is retracted. The transfer operation of the document image is continued during the retard operation.

In a step A10, whether the designated number of copies have been produced or not is checked, and if they have, the process proceeds to a step A11 where the photoconductor drum 20 is post-rotated to clean the surface of the photoconductor drum 20. Thus, the copy operation ends.

In the analog copy mode, the erase operation is performed in accordance with the size of the document or the size of the copy paper.

Figure 8C:
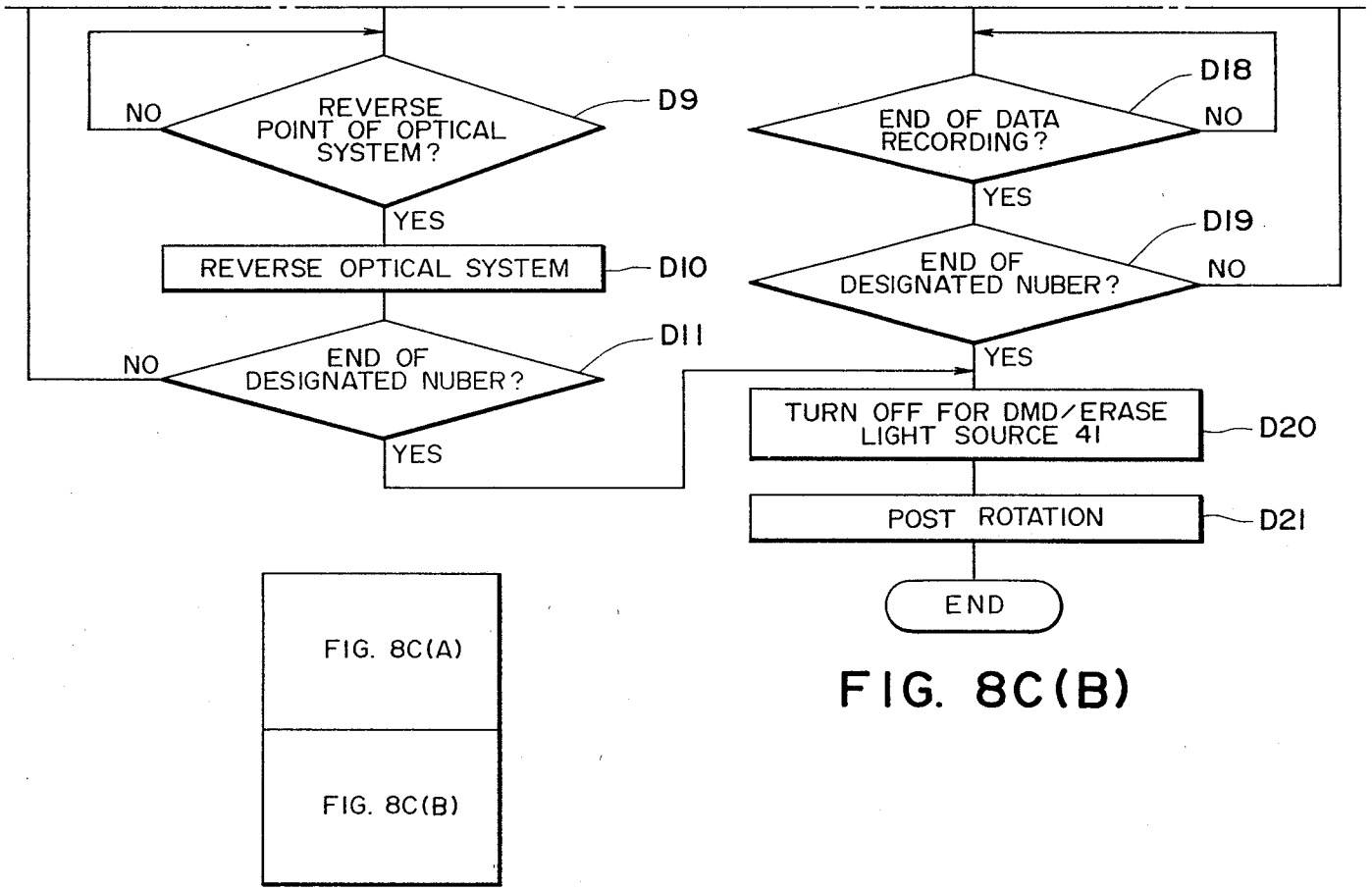
Figure 8C:
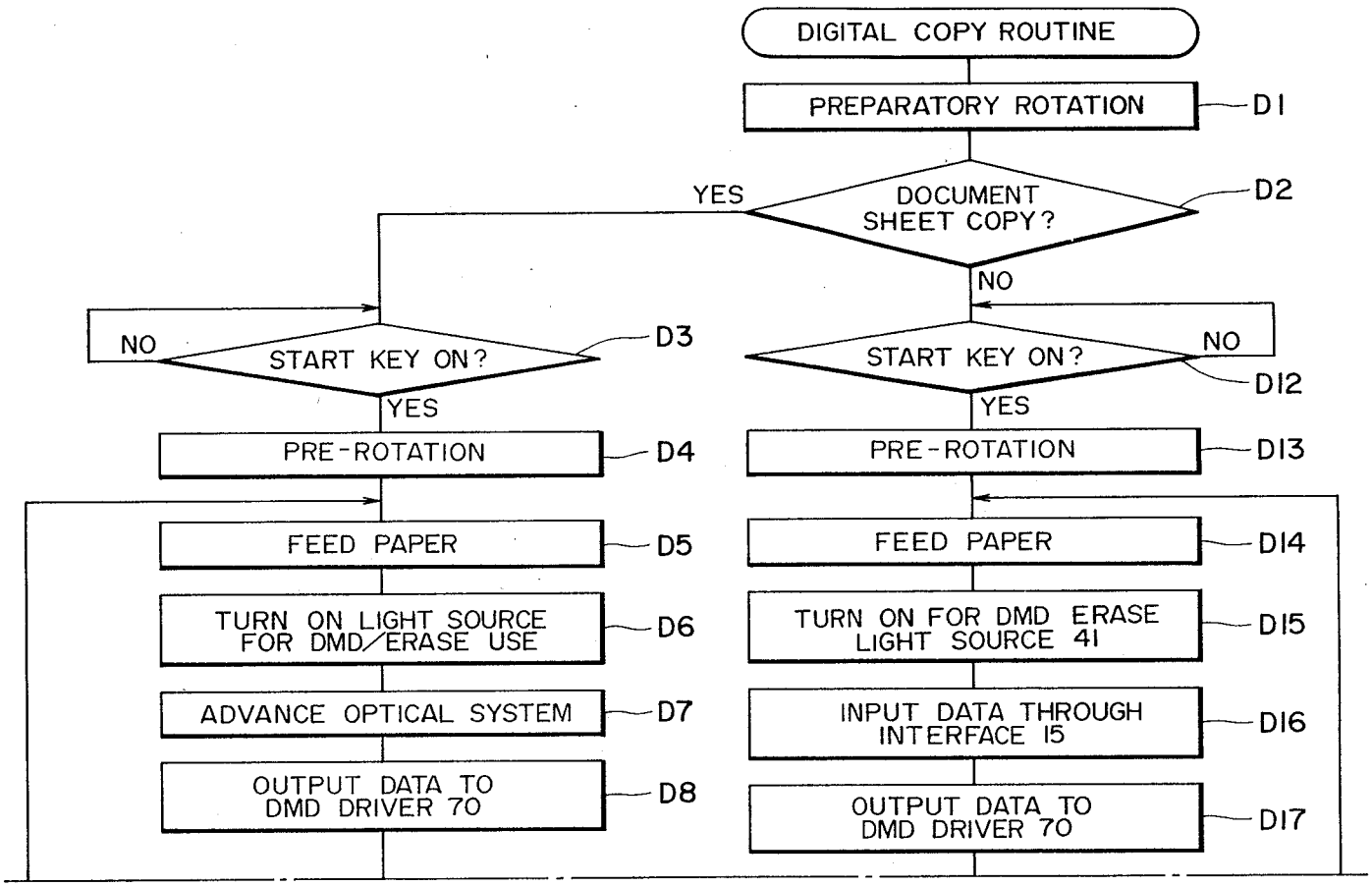

FIG. 8C shows the digital copy routine.

In a step D1, the photoconductor drum 20 is preparatory-rotated. In a step D2, whether the document is to be copied or external data is to be printed out is checked, and if it is the copying of the document, the process proceeds to a step D3 where whether the start key has been depressed or not is checked, and if it has, the process proceeds to a step D4.

In a step D4, pre-rotation is performed, in a step D5, a paper is fed, and in a step D6, the DMD/erase light source 41 is turned on. In a step D7, the optical system is advanced and the document is read by the CCD image sensor 48. In a step D8, the read data is serially supplied to the DMD drive circuit 70 to write the document image onto the photoconductor drum 20. The image is developed by the developing unit 17 and transferred to the copy paper.

In a step D9, whether the optical system is at the reversal position or not is checked, and if it is, the process proceeds to a step D10 where the optical system is retracted. When the designated number of copies have been produced in a step D11, the process proceeds to a step D20.

In the step D2, if the external data is to be printed out, the process proceeds to a step D12. If the start key is depressed in the step D12, the process proceeds to a step D13. In the step D13, the pre-rotation is performed, in a step D14, the paper is fed, and in a step D15, the DMD/erase light source 41 is turned on.

In a step D16, the data to be printed out is supplied from the external equipment through the interface 15, and in a step D17, the data is serially supplied to the DMD drive circuit 70 to write the data image onto the photoconductor drum 20. The image is developed by the developing unit 17 and transferred to the copy paper.

Figure 8D:
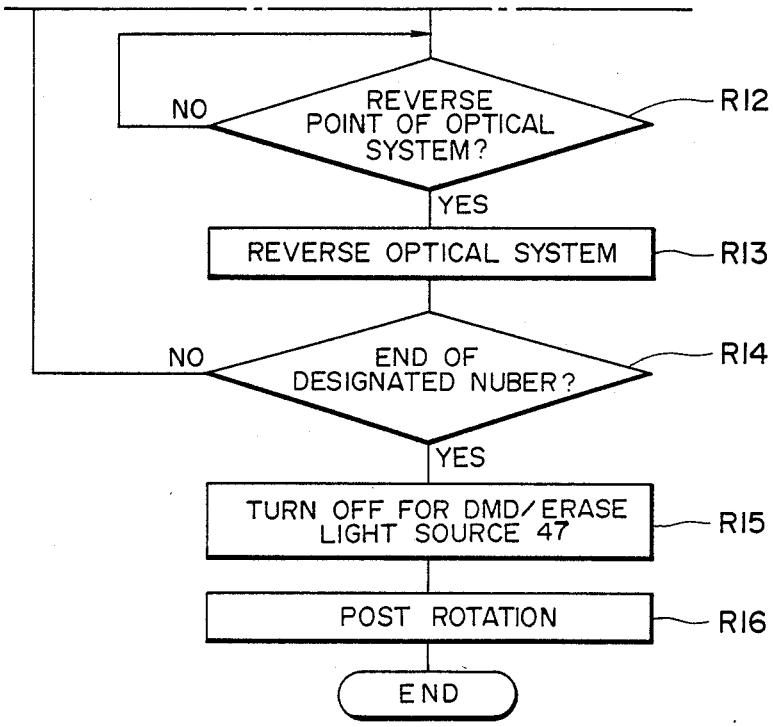
Figure 8D:
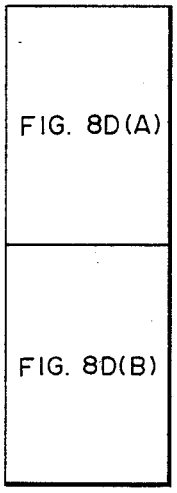
Figure 8D:
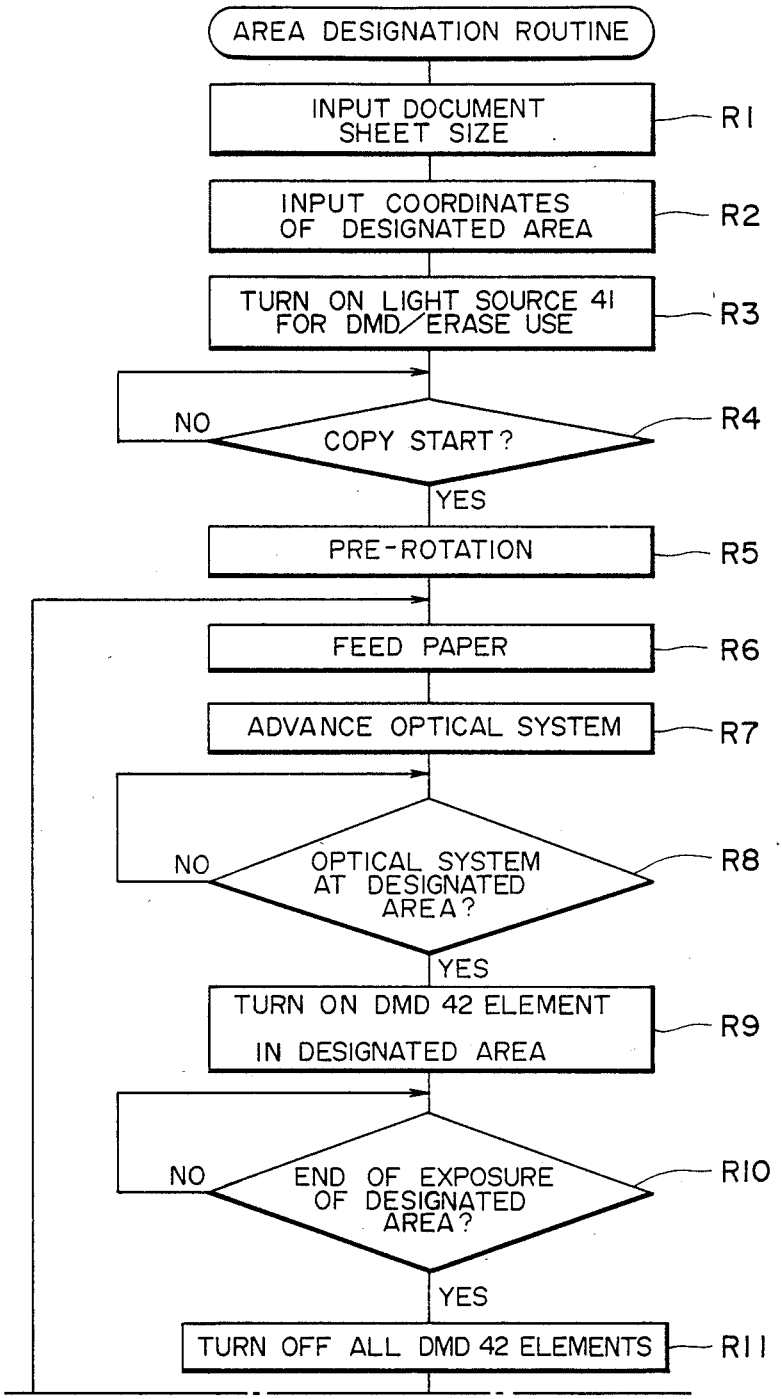

In a step D18, whether all data have been recorded or not, and in a step D19, whether the designated number of printouts have been prepared or not. If they have, the process proceeds to a step D20. In the step D20, the DMD/erase light source 41 is turned off and in a step D21, the post rotation is performed Thus, the copy operation ends FIG. 8D shows the area designation routine.

In a step R1, the document sheet size is input, and in a step R2, the coordinates of the designated area are input.

In a step R3, the DMD/erase light source 41 is turned on, in a step R4, the copy start key is depressed, in a step R5, the pre-rotation is performed, in a step R6, the paper is fed, and in a step R7, the optical system is advanced to exposure-scan the document. The document image is focused onto the photoconductor drum 20 but it is erased by the DMD/erase light source 41. In a step R8, when the optical system comes to the designated area, the process proceeds to a step R9 where those DMD elements 42 which correspond to the designated area are turned on to prevent the designated area from being erased.

In a step R10, the position of the optical system is checked to determine whether the exposure scan for the designated area has been completed or not. If it has, the process proceeds to a step R11. In the step R11, all DMD elements 42 are turned off to erase the document image on the photoconductor drum 20. In a step R12, whether the optical system is at the reversal position or not is checked, and if it is, the optical system is retracted in a step R13.

In a step R14, if the designated number of copies performed in a step R16. Thus, the area-designated copy operation terminates.

Figure 8E:
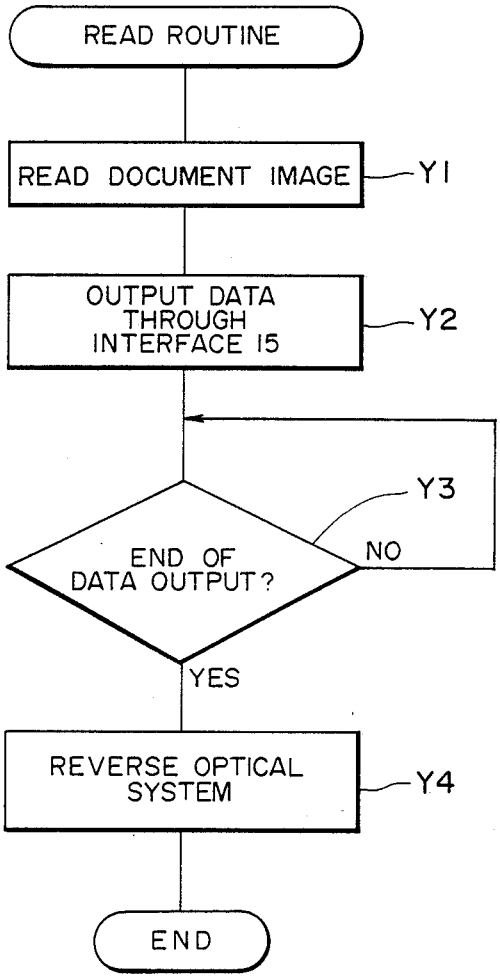

FIG. 8E shows the read routine.

In a step Y1 of FIG. 8E, the optical system is advanced and the document is read by the CCD image sensor 48, and in a step Y2, the read data is output through the interface 15.

In a step Y3, if the reading of the document is completed, the optical system is retracted in a step Y4 and the read operation is terminated.

Figure 8F:
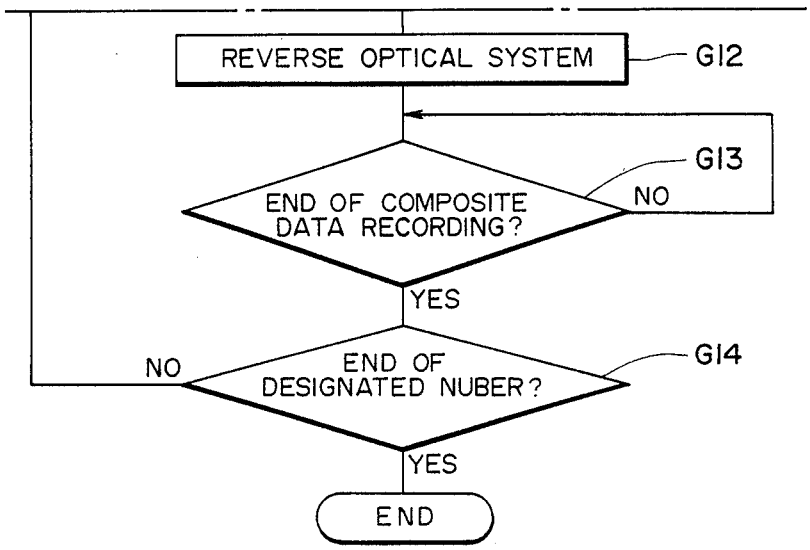
Figure 8F:
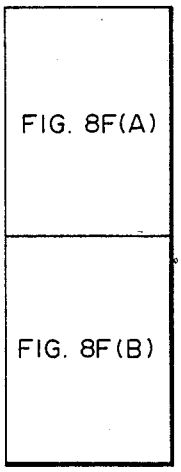
Figure 8F:
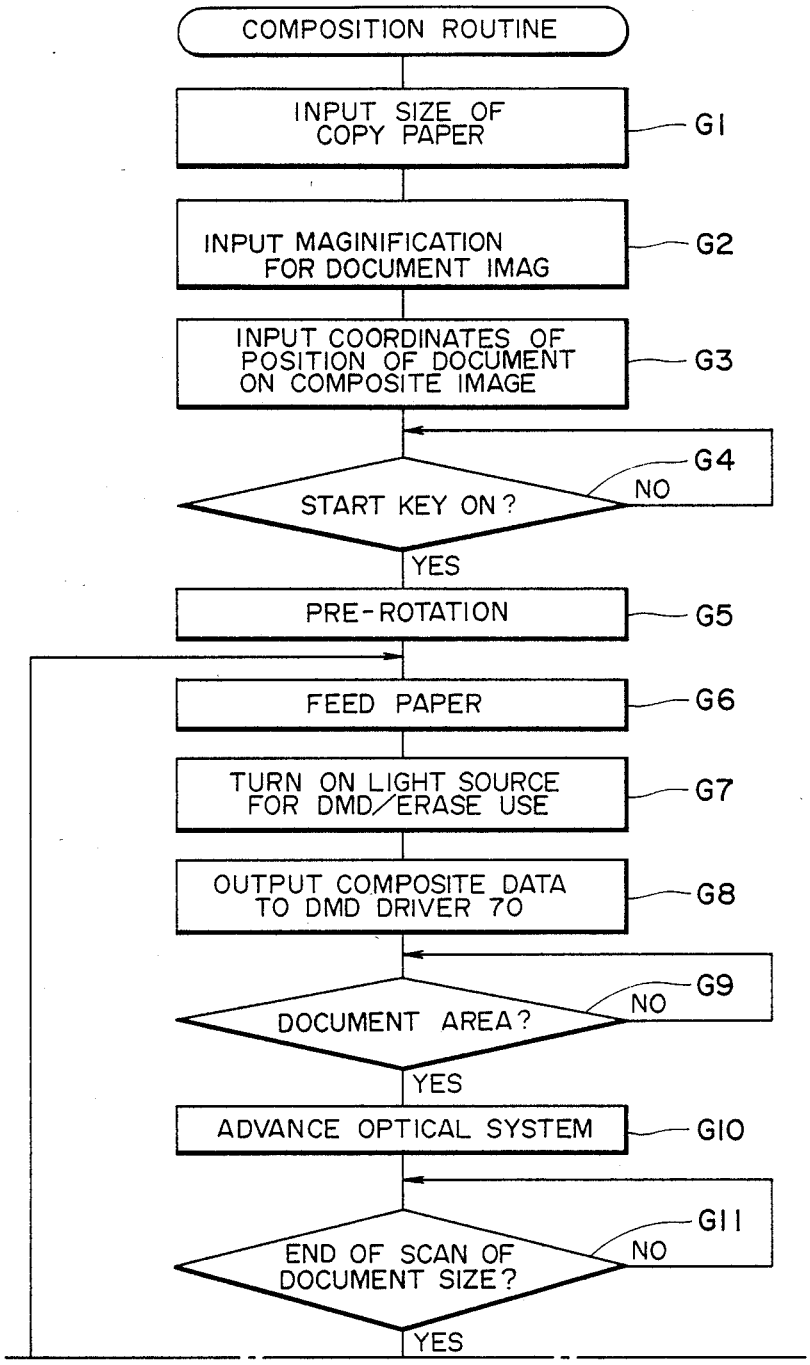

FIG. 8F shows the composite routine.

In a step G1, the size of the copy paper is input, in a step G2, the magnification for the document image is input, and in a step G3, the coordinates of the document on the composite image are input.

In a step G4, the start key is depressed. In a step G5, the pre-rotation is performed. In a step G6, the paper is fed, and in a step G7, the DMD/erase light source 41 is turned on.

In a step G8, the composite data supplied to the DMD driver 70 through the interface 15 is sequentially output to write the data image onto the photoconductor drum 20. In a step G9, whether the area is the document area or not is checked and the image is transferred to the copy paper.

If the area is the document area in the step G9, the optical system is advanced in a step G10 to expose-scan the document. The designated magnification is set and the light reflected from the document is directed only to the document area by the zoom lens 11 so that the document image is focused onto the photoconductor drum 20. Simultaneously therewith, the composite data is written onto the photoconductor drum 20 by the DMD 42. The DMD elements corresponding to the document area are all kept on.

In a step G11, the position of the optical system is checked to determine whether the exposure scan of the document has been completed or not, and if it has, the light path of the analog optical system to the photoconductor drum 20 is blocked (the exposure lamp 3 is turned off or any of the mirrors 4–9 of the optical system is rotated) to prevent the light from reaching the photoconductor drum 20. Thus the optical system is retarded.

Figure 8G:
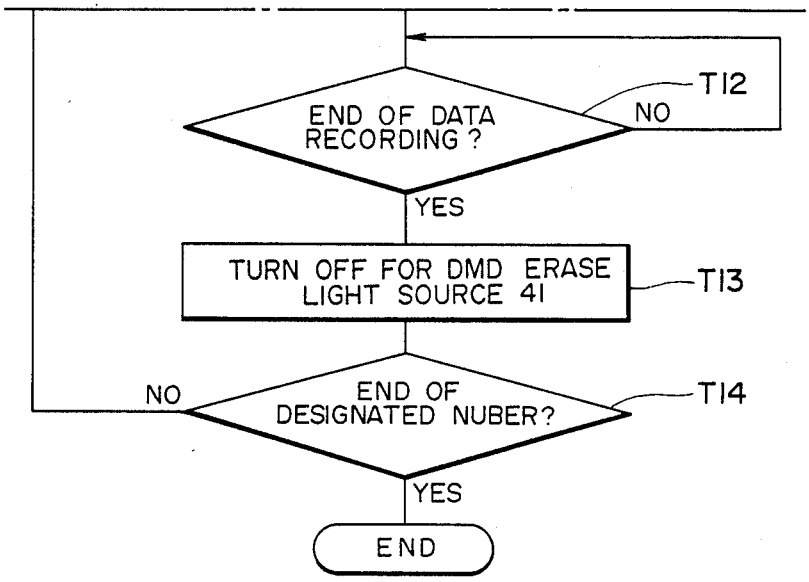
Figure 8G:
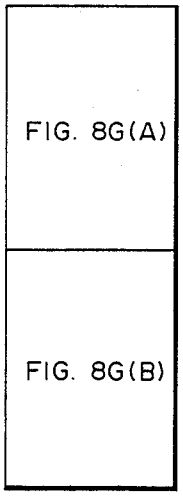
Figure 8G:
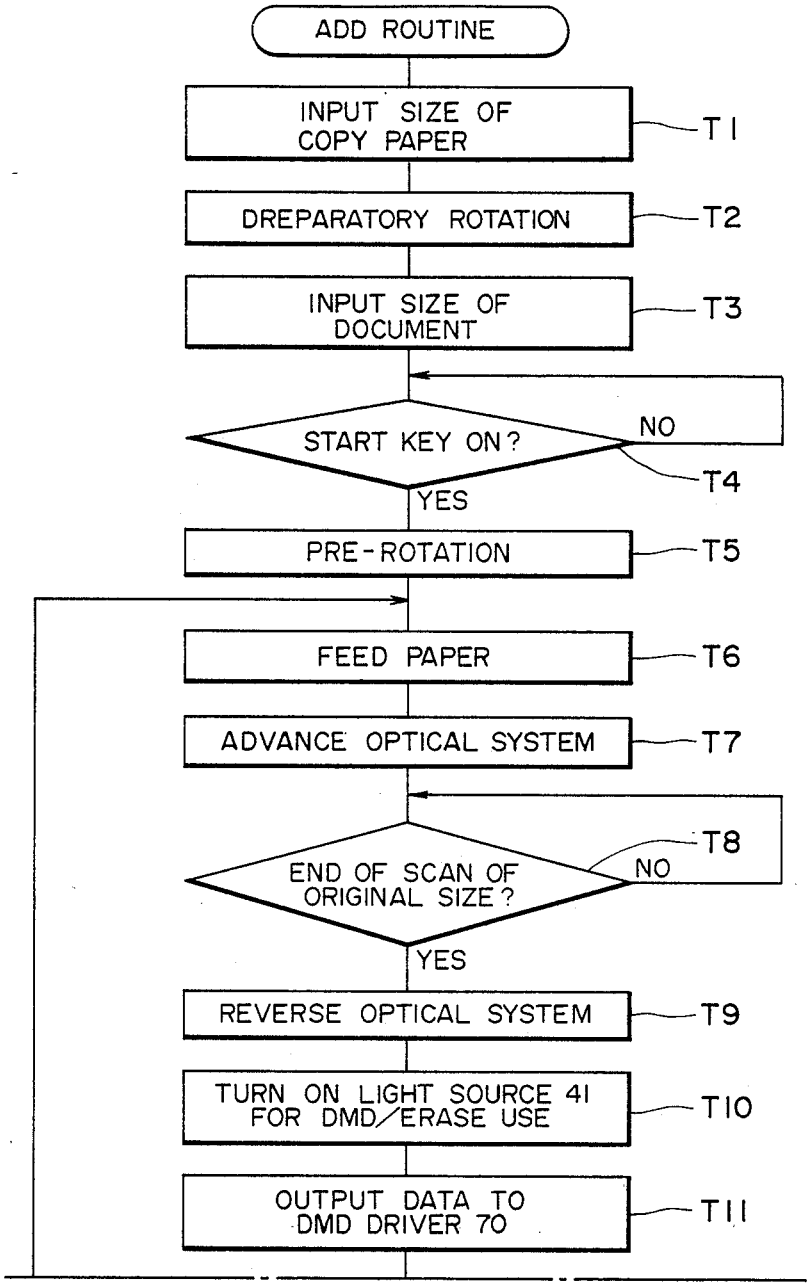

In a step G13, whether the printing of the composite data has been completed or not is checked, and if it has, the process proceeds to a step G14. In the step G14, if the designated number of printers have been prepared, the DMD/erase light source 41 is turned off, the post rotation is performed and the composite operation is terminated FIG. 8G shows the add routine In a step T1, the size of the copy paper is input. In a step T2, the preparatory rotation is performed. In a step T3, the size of the document sheet is input.

In a step T4, the start key is depressed. In a step T5, the pre-rotation is performed, in a step T6, the paper is fed, and in a step T7, the optical system is advanced and the document is exposure-scanned to focus the document image onto the photoconductor drum 20.

In a step T8, the end of the exposure scan for the document is detected. In a step T9, the optical system is retracted. In a step T10, the DMD/erase light source 41 is turned on. In a step T11, the additional data received through the interface 15 is supplied to the DMD drive circuit 70 and the additional data is written onto the photoconductor drum 20 following to the document image. The composite image is then transferred to the copy paper and printed out.

In a step T12, whether the image and the additional data have been printed out or not is checked, and if they have, the process proceeds to a step T13 where the DMD/erase light source 41 is turned off and the proceeds to a step T14. In the step T14, whether the designated number of printouts have been prepared or not, and if they have, the post-rotation is performed and the add operation is terminated.

As described above, by providing the DMD optical system in the conventional analog copying machine and connecting the PC/WP 103 and 104 to the copying machine through the interface 15, the erase operation for the analog copy, digital copy and enlarge/reduce copy, and the composite copy of the document image and the digital data can be attained.

Figure 9:
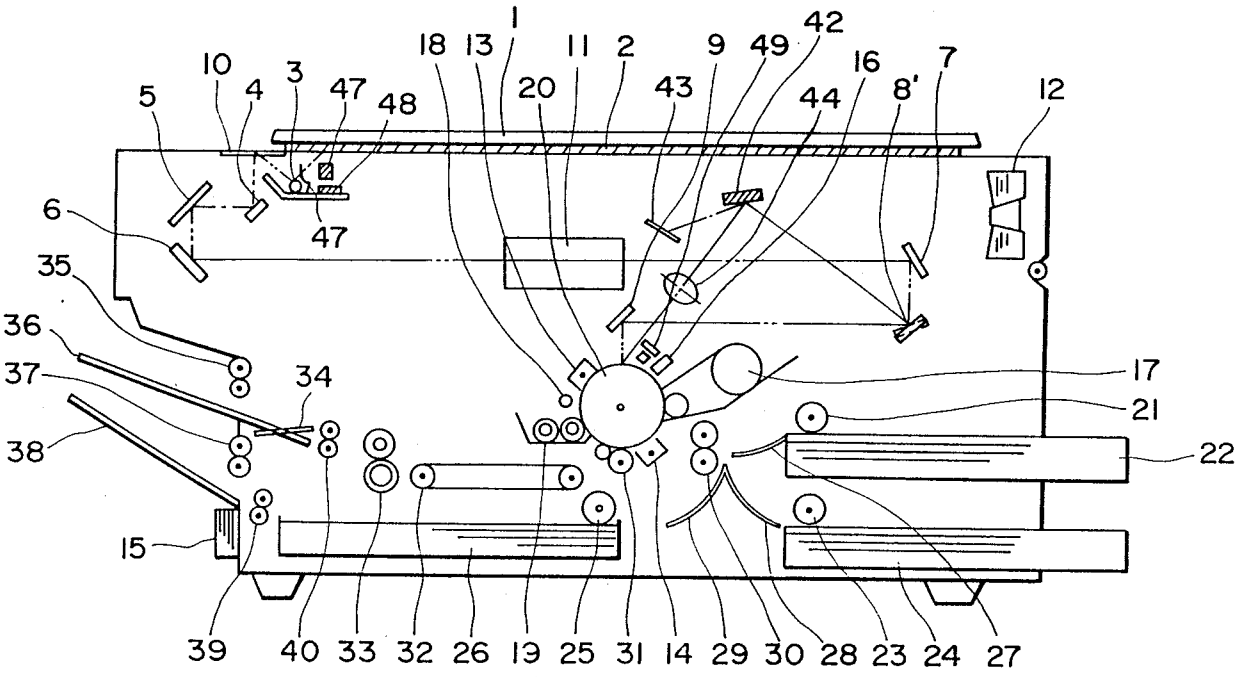
FIG. 9 shows another embodiment of the analog/-digital copying machine.

FIG. 9 shows another embodiment of the analog/-digital copying machine.

Only the differences between this embodiment of analog/digital copying machine and that of FIG. 1 are explained.

The analog/digital copying machine of FIG. 9 is characterized by the use of the exposure lamp 3 as a light source for the DMD 42.

In a normal analog copy mode, the document on the document table 2 is exposure-scanned by the optical system (exposure lamp 3 and first mirror 4), and the light reflected by the document sheet passes through the second mirror 5, third mirror 6, zoom lens 11, fourth mirror 7, fifth mirror 8 and sixth mirror 9 and is focused onto the photoconductor drum 20. Then, the copy operation explained in connection with the FIG. 1 is performed.

In the printer mode of operation, the optical system is fixed and the exposure lamp 3 irradiates the standard white plate. The light reflected thereby is directed to the fifth mirror 8' through the first mirror, second mirror 5, third mirror 6, zoom lens 11 and fourth mirror 7. The fifth mirror 8' has been slightly rotated from a normal position so that the light from the fourth mirror 7 is directed to the DMD 42. As explained in connection with FIG. 1, the DMD elements 42 are turned on and off in accordance with the data supplied through the interface 15 to write the data onto the photoconductor drum 20. The data is then transferred to the copy paper.

The control unit of the analog/digital copying machine of FIG. 9 is identical to that of the analog/digital copying machine of FIG. 1. The difference in the control operation from the control unit of the copying machine of FIG. 1 is that the fifth mirror 8' is controlled, and when the digital copy of the document is to be made, the document is read by the CCD image sensor 48, temporarily stored in the memory, the optical system is fixed at the home position and the data read from the document is written onto the photoconductor drum 20 by the DMD 42.

Numeral 49 denotes an erase lamp which irradiates the light to the non-image area on the photoconductor drum 20 to erase that area.

The analog/digital copying machine is connected to the PC/WP 103 and 104 through the interface 15 so that the image can be edited or composed by the PC/WP 103 and 104.

Multiple recording of the digital data on the analog document is attained by the analog/digital copying machine of FIG. 9.

Figures 10A, 10B, 10C, 10D, 10E, 10F, 10G:
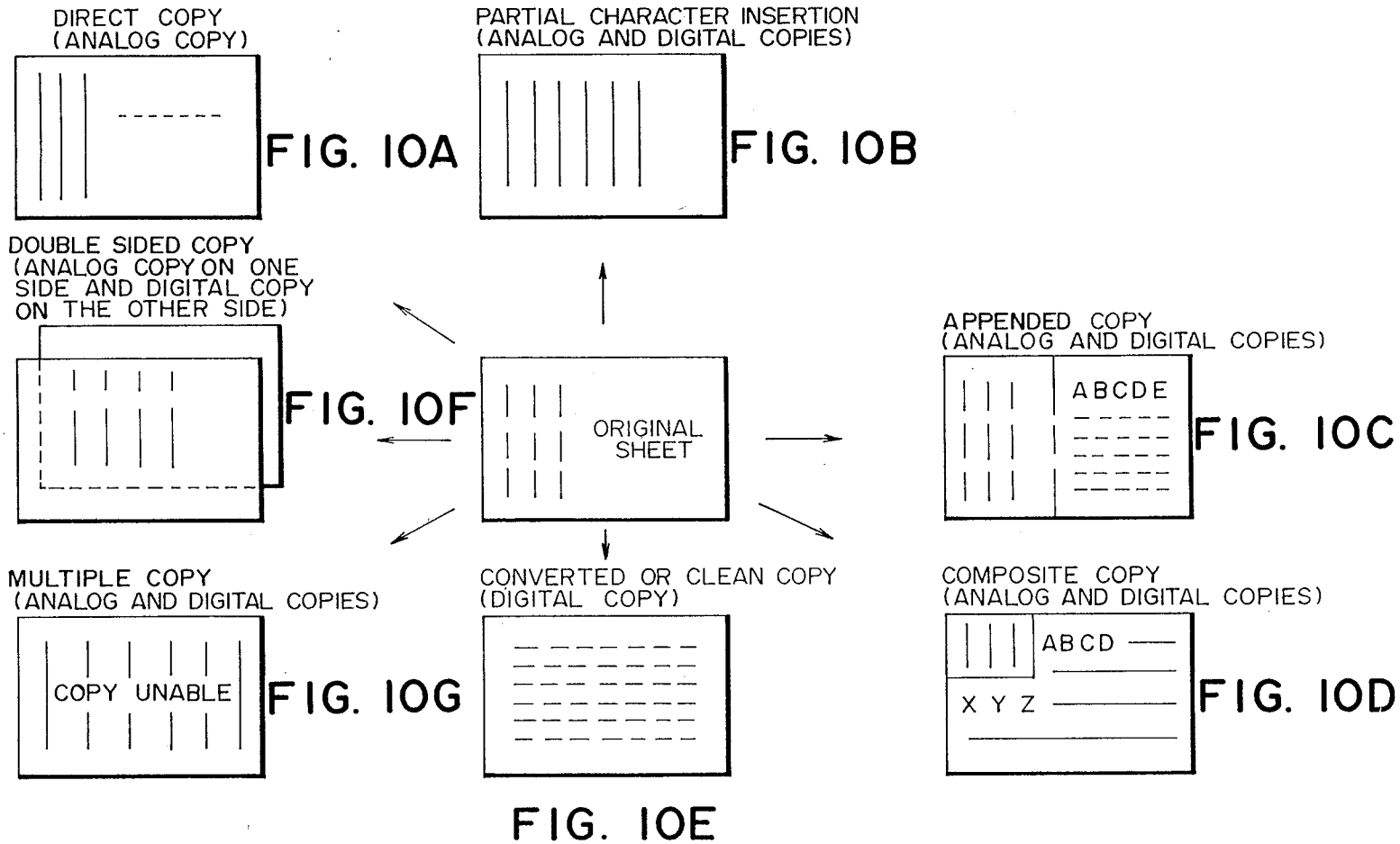
FIGS. 10A to 10G show examples of copy produced by the analog/digital copying machine of FIG. 9.

FIG. 10 shows examples of copies prepared by the analog/digital copying machine of FIG. 9. The copies shown in FIGS. 10A, 10C, 10D, 10E and 10F can be prepared by the operations explained in connection with FIGS. 7A, 7C,7D,7E,7F and 8A–8G, with the addition of the control to the rotation of the fifth mirror 8'. The light reflected from the document is directed to the DMD 42 by rotating the fifth mirror 8'. If all DMD elements of the DMD 42 are off, the DMD 42 totally reflects the document image light to the photosensitive drum 20 to focus the document image onto the photoconductor drum 20.

When the additional copy of FIG. 10C is to be prepared, the rotation of the photoconductor drum 20 is temporarily stopped when the document image has been focused onto the photoconductor drum 20, and the optical system is returned to the home position to illuminate the standard white plate 10 and the DMD 42 is driven in accordance with the data. If the surface of the document table cover 1 facing the document table 2 is colored white, the light to write the data can be directed to the DMD 42 without temporarily stopping the rotation of the photoconductor drum 20.

When the composite copy of FIG. 10D is to be prepared, the document table cover is colored white, and the optical system exposure-scans the white surface of the document table cover 1 and the document sheet and the digital data is written by the DMD 42 so that the document image and the digital data are combined.

In FIGS. 10B and 10G, the digital data is multiple-copied on the document copy. The multiple copy mode is accomplished b arranging the DMD 42 on the optical path of the analog optical system, focusing the light reflected from the document onto the photosensitive drum 20 and driving the DMD 42 in accordance with the data to be overwritten.

Figure 11:
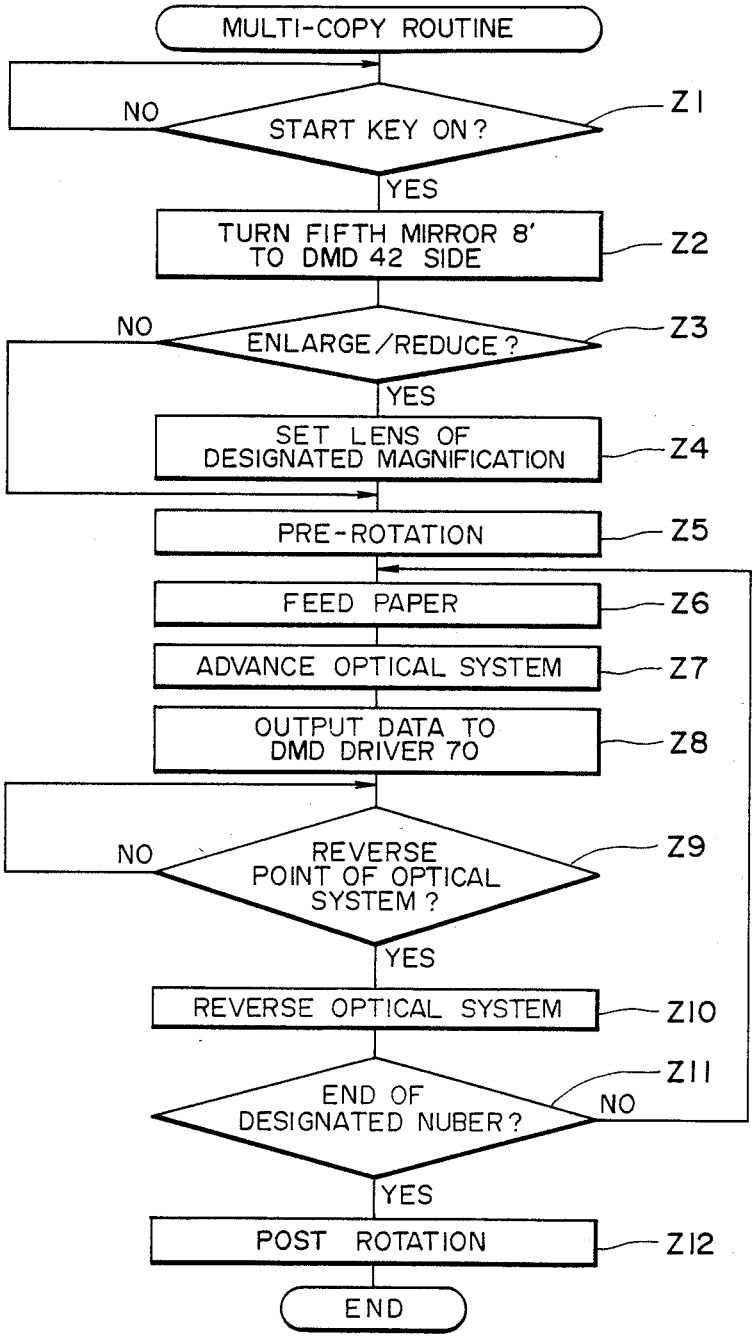
FIG. 11 shows a multiple copy routine.

FIG. 11 shows a flow chart for the multiple copy mode. The analog/digital copying machine of FIG. 9 is set in the multiple copy mode.

In a step Z1, whether the start key has been depressed or not is checked, and if it has, the fifth mirror 8' is rotated in a step Z2 to reflect the light to the DMD 42.

In a step Z3, if the enlarge/reduce copy mode is designated, the lens is set to the designated magnification in a step Z4, and if a unity magnification is designated, the lens is set to the unity magnification and the process proceeds to a step Z5.

In the step Z5, the pre-rotation is performed, in the step Z6, the paper is fed, in the step Z7, the optical system is advanced, and in the step Z8, the data to be multiple-copied is supplied to the DMD drive circuit 70. The document image and the data image to be overlapped are focused onto the photoconductor drum 20. The images are developed by the developing unit 17 and transferred to the copy paper.

In a step Z9, whether the exposure scan for the document has been completed and the optical system has come to the reversal position or not is determined. If the optical system has come to the reversal position, the optical system is retracted in a step Z10. In a step Z11, whether the designated number of copies have been prepared or not is checked, and if they have, the post rotation is performed in a step Z12. Thus, the multiple copy mode terminates.

The data to be multiple-printed may be supplied from the external equipment (PC/WP 103 or 104) through the interface 15, or a character generator may be provided in the analog (digital copying machine of FIG. 9 and the data may be read from the character generator in accordance with the key input from the console unit and the data may be supplied to the DMD drive circuit 70.

In FIG. 10B, the characters are printed in a blank area of the document, and in FIG. 10G, the data are overprinted on the document.

As described above, by providing the DMD optical system to the analog copying machine, the digital copy can be prepared and the data supplied from the external equipment through the interface 15 can be printed out. The document data can be edited by the external equipment, and the analog copy of the document and the digital data can be combined. In this manner, the analog copying machine ca be used in multiple functions.

Since the DMD 42 is arranged in the analog optical system and the light source is shared, the machine can be used as a printer and perform the multiple recording.

In accordance with the present embodiment, the analog/digital copying machine comprises the light source, the image focusing means for forming the light image, the light control means having a plurality of electro-mechanical transducer elements arranged in the light path from the light source to the image forming means, and the drive means for driving the light control means in accordance with the data. When the document image is to be formed by the image forming means, the light source illuminates the document, and when the data images is to be formed, the light source is used as the light source to the light control means. Accordingly, the light source for the light control means need not be provided and the construction of the machine is simplified and the image formation of the document can be attained in various ways.

Figure 12:
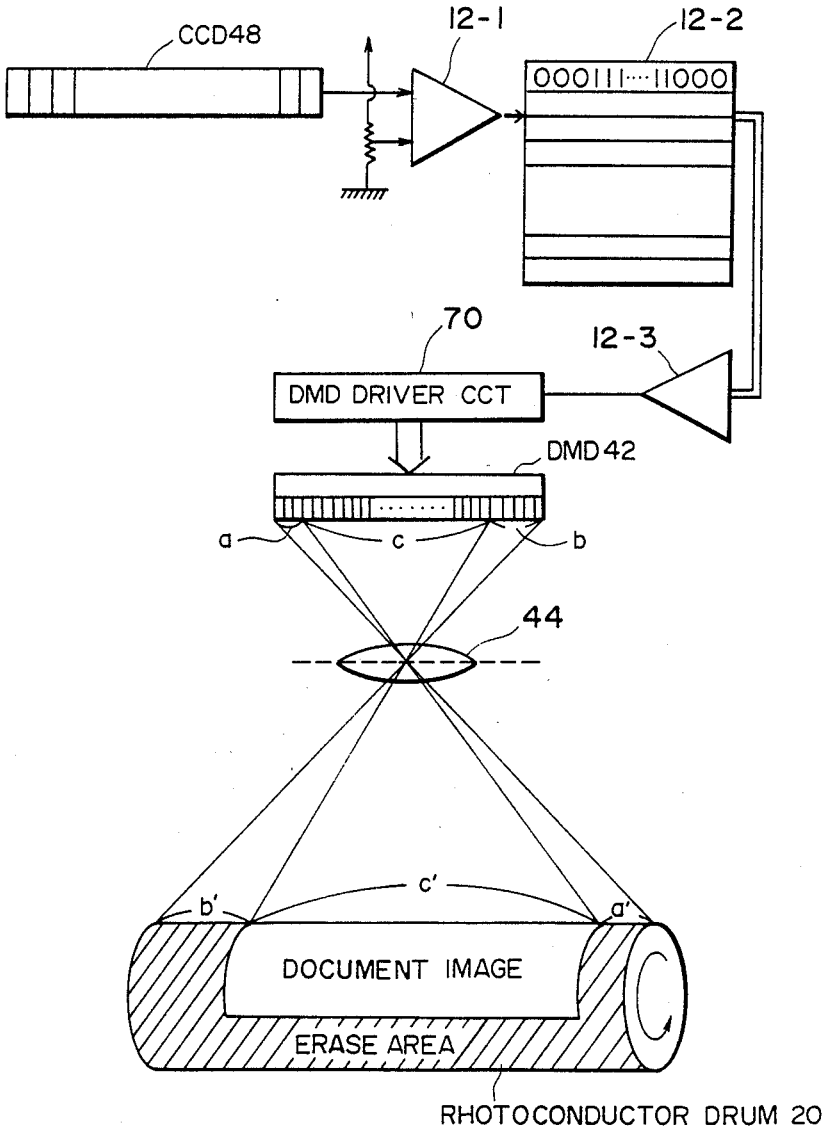
FIG. 12 shows an auto-erase in accordance with a text.
Figure 13:
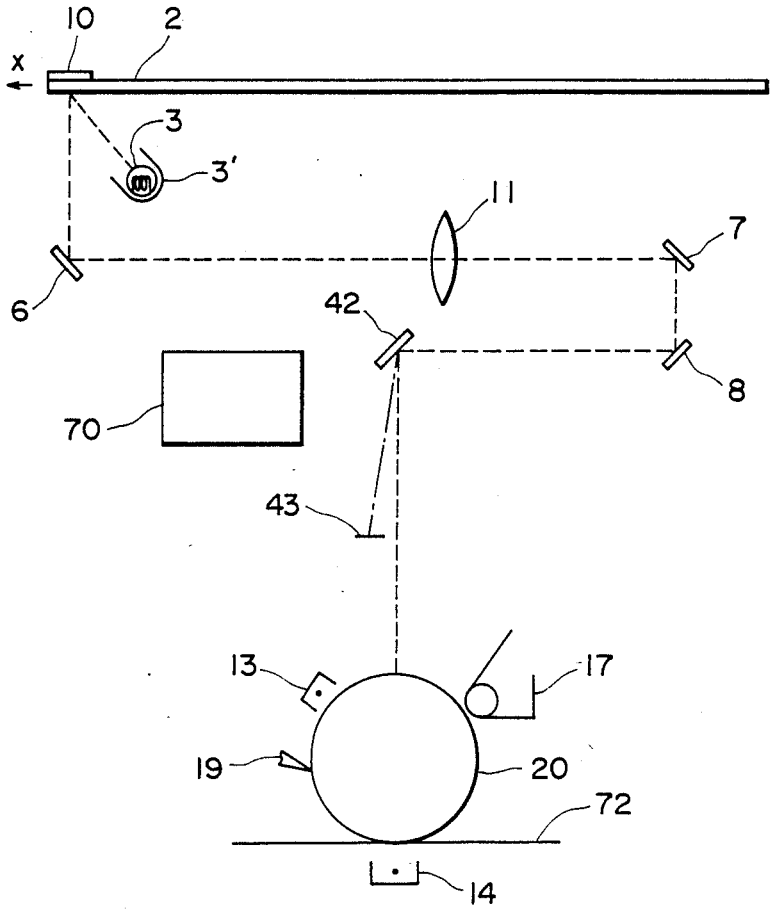
FIG. 13 shows an embodiment of an analog/digital recording optical system.

FIG. 13 shows an analog/digital recording optical system having the DMD 42 arranged in a light path of the optical system. In FIG. 13, the like numerals to those shown in FIGS. 1–12 denote the like elements and the explanation thereof is omitted.

Numeral 3' denotes a lamp cover for the exposure lamp 3 and numeral 72 denotes a copy paper fed from the paper cassette 22 or 24.

The optical system of FIG. 9 is of optical system moving type while the optical system of FIG. 13 is of the document table moving type. In FIG. 13, the first mirror 4 and the second mirror 5 of FIG. 9 are omitted, and the DMD 42 is provided in place of the sixth mirror 9. This is essentially equivalent to the status of the copying machine of FIG. 9 in which the fifth mirror 8 is rotated toward the DMD 42.

In the optical system of FIG. 13, when the document is to be copied, all DMD elements of the DMD 42 are turned off to reflect the document image light to the photoconductor drum 20. In the printer mode, the illumination lamp 3 illuminates the standard white plate and the DMD 42 is driven in accordance with the image signal to focus the image onto the photoconductor drum 20.

By using the DMD in this manner, the analog copying machine can have a function of the digital copying machine and various other functions.

What we claim is:

1. An image processing apparatus comprising:
output means for outputting a first image as optical information;
image forming means for forming an image using a light beam having the optical information from said output means;
light control means having a plurality of electro-mechanical transducer elements, arranged in a light path from said output means to said image forming means;
means for generating second image data; and
drive means for driving said light control means in accordance with the second image data;
wherein said drive means drives said light control means in accordance with the second image data so as to optically combine the first image and an image of the second image data.

2. An apparatus according to claim 1, wherein said output means outputs a reflected light from an original document as optical information by exposure-scanning the document.

3. An image processing apparatus comprising:
a light source;
means for scanning an original document using said light source;
image forming means for forming an image on the basis of light reflected from the original document and a light from said light source;
light control means having a plurality of electro-mechanical transducer elements arranged in a light path from said light source to said image forming means;
means for generating image data; and
drive means for driving said light control means in accordance with the image data;
wherein said drive means drives said light control means in accordance with the image data, thereby causing said image forming means to form an image corresponding to the image data, and
said light source is adapted for forming each of an image corresponding to the original document and an image corresponding to the image data.

4. An image processing apparatus according to claim 3 further comprising a standard white plate, said light source illuminating said standard white plate when the data image is to be formed so that a light reflected from said standard white plate is used as the light source to said light control means.

5. An image processing apparatus according to claim 3, wherein said drive means drives said light control means in accordance with the image data, thereby controlling light reflected from said original document to combine an image corresponding to the original document and an image corresponding to the image data.

6. An apparatus according to claim 5, further comprising means for variable magnifying an image of the original document, wherein a variable magnified image of the original document and an image of the image data are combined.

7. An image processing apparatus according to claim 3 wherein said electro-mechanical transducer elements are small swingable mirrors, and said drive means controls the reflection planes of said small mirrors in accordance with the data.

8. An image processing apparatus according to claim 7 further comprising means for blocking one of two direction reflection lights by controlling the reflection planes of said small mirrors.

9. An image processing apparatus according to claim 8 wherein the other of said two direction reflection lights is directed to said image forming means.

10. An apparatus according to claim 3 wherein said image forming means has a photoconductor on which the image is formed.

11. An image processing apparatus comprising:
first and second light sources;
scan means for exposure-scanning a document using the first light source;
latent image forming means for forming a latent image of the document by using a reflected light from the document;
image forming means for providing a visible image from said latent image;
light control means having a plurality of electro-mechanical transducer elemetns, arranged on a light path from said second light source to said latent image forming means; and
means for designating an area of the document to be formed as an image, wherein said designating means includes means for reading the document and designating an area of the document in accordance with data from said reading means;
wherein said light control means erases a latent image of the document formed by said latent image forming means on the basis of an output from said designating means, thereby to form an image corresponding to the areas of the document designated by said designating means.

12. An image processing apparatus according claim 11 wherein said erase means includes drive means for driving said electro-mechanical transducer elements in accordance with data.

13. An image processing apparatus according to claim 12 wherein said electro-mechanical transducer elements are small swingable mirrors, and said drive means controls the reflection planes of said small mirrors in accordance with the data.

14. A image processing apparatus according to claim 13 further comprising means for blocking one of two direction reflection lights by controlling the reflection planes of said small mirrors.

15. An image processing apparatus according to claim 14 wherein the other of said two direction reflection lights is directed to said latent image forming means.

* * * * *

UNITED STATES PATENT AND TRADEMARK OFFICE

CERTIFICATE OF CORRECTION

PATENT NO. : 4,888,616

DATED : December 19, 1989

INVENTOR(S) : MASANORI NANAMURA, ET AL.

It is certified that error appears in the above-identified patent and that said Letters Patent is hereby corrected as shown below:

SHEET 10 OF 26

FIG. 7B, "ARER" should read --AREA--.
FIG. 7D, "(ANALOG AND DIGITAL COPIES" should read --(ANALOG AND DIGITAL COPIES)--.

SHEET 12 OF 26

FIG. 8B, "DREPARATORY" should read --PREPARATORY-- and "NUBER" should read --NUMBER--.

SHEET 13 OF 26

FIG. 8C, "NUBER?" should read --NUMBER?--.
FIG. 8C(B), "NUBER?" should read --NUMBER?--.

SHEET 15 OF 26

FIG. 8D(B), "NUBER?" should read --NUMBER?--.

SHEET 18 OF 26

FIG. 8F(B), "NUBER?" should read --NUMBER?--.

SHEET 19 OF 26

FIG. 8F(A), "MAGINIFICATION" should read --MAGNIFICATION-- and "IMAG" should read --IMAGE--.

UNITED STATES PATENT AND TRADEMARK OFFICE

CERTIFICATE OF CORRECTION

PATENT NO. : 4,888,616

DATED : December 19, 1989

INVENTOR(S) : MASANORI NANAMURA, ET AL.

It is certified that error appears in the above-identified patent and that said Letters Patent is hereby corrected as shown below:

SHEET 20 OF 26

FIG. 8G(B), "NUBER?" should read --NUMBER?--.

SHEET 21 OF 26

FIG. 8G(A), "DREPARATORY" should read --PREPARATORY--.

SHEET 25 OF 26

FIG. 12, "RHOTOCONDUCTOR" should read --PHOTOCONDUCTOR--.

COLUMN 1

Line 32, "an read" should read --an image read--.
Line 34, "a" should read --its-- and "its" should read --a--.
Line 67, "FIGS. 2A-E" should read --FIGS. 2A-2E--.

COLUMN 2

Line 17, "a" should be deleted.
Line 65, "voltage VF" should read --voltage $V_F$--.
Line 66, "voltage $V_f$" should read --voltage $V_F$--.

COLUMN 3

Line 35, "signal" should read --signal.--. (1st occurrence)
Line 37, "numbers" should read --number--.

UNITED STATES PATENT AND TRADEMARK OFFICE

CERTIFICATE OF CORRECTION

PATENT NO. : 4,888,616

DATED : December 19, 1989

INVENTOR(S) : MASANORI NANAMURA, ET AL.

It is certified that error appears in the above-identified patent and that said Letters Patent is hereby corrected as shown below:

COLUMN 4

Line 56, "depress" should read --depresses--.

COLUMN 5

Line 54, "OA" should read --OA--.
Line 58, "embodiment" should read --embodiment.--.
Line 66, "3-5." should read --3-5).--.

COLUMN 7

Line 22, "the" should read --of the--.
Line 28, "its" should read --a--.
Line 29, "a" should read --its--.

COLUMN 8

Line 17, "mechanics electronics" should read --mechanics-electronics--.
Line 20, "been" should read --been rapidly--.
Line 21, "roof" should read --of--.
Line 63, "FIGS. 7-7F shows" should read --FIGS. 7A-7F show--.

COLUMN 10

Line 25, "t" should read --to--.

UNITED STATES PATENT AND TRADEMARK OFFICE

CERTIFICATE OF CORRECTION

PATENT NO. : 4,888,616

DATED : December 19, 1989

INVENTOR(S) : MASANORI NANAMURA, ET AL.

It is certified that error appears in the above-identified patent and that said Letters Patent is hereby corrected as shown below:

COLUMN 11

Line 14, "of" should read --or--.
Line 20, "proceed" should read --proceeds--.

COLUMN 12

Line 44, "or not." should read --or not is checked.--.
Line 48, "ends" should read --ends.--.

COLUMN 13

Line 6, "copies" should read --copies have been made, the DMD/erase light source 41 is turned off in a step R15, and the post rotation is--.
Line 48, "is" should read --are--.
Line 57, "terminated" should read --terminated.--.

COLUMN 14

Line 11, "the pro-" should read --the process pro- --.
Line 13, "not," should read --not is checked,--.
Line 25, "of" should read --of the--.

COLUMN 16

Line 6, "analog(digital" should read --analog/digital--.
Line 35, "is" should read --are--.

UNITED STATES PATENT AND TRADEMARK OFFICE

CERTIFICATE OF CORRECTION

PATENT NO. : 4,888,616

DATED : December 19, 1989

INVENTOR(S) : MASANORI NANAMURA, ET AL.

It is certified that error appears in the above-identified patent and that said Letters Patent is hereby corrected as shown below:

COLUMN 18

Line 28, "elemetns," should read --elements,--.
Line 45, "with data." should read --with the data.--.
Line 47, "claim 12" should read --claim 12--.

Signed and Sealed this

Ninth Day of July, 1991

*Attest:*

*Attesting Officer*

HARRY F. MANBECK, JR.

*Commissioner of Patents and Trademarks*